US008192310B2

(12) United States Patent
Harris et al.

(10) Patent No.: US 8,192,310 B2
(45) Date of Patent: Jun. 5, 2012

(54) EXPANDABLE BLUNT ARROW POINT APPARATUS AND METHODS

(75) Inventors: H. Jason Harris, Stansbury Park, UT (US); Ross M. Hinschberger, West Valley City, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 66 days.

(21) Appl. No.: 12/795,969

(22) Filed: Jun. 8, 2010

(65) Prior Publication Data

US 2011/0300975 A1 Dec. 8, 2011

(51) Int. Cl.
*F42B 6/08* (2006.01)

(52) U.S. Cl. ..... 473/582; 473/583

(58) Field of Classification Search ..... 43/6; 473/578, 473/582, 583, 584
See application file for complete search history.

(56) References Cited

U.S. PATENT DOCUMENTS

| | | | | |
|---|---|---|---|---|
| 3,241,836 | A * | 3/1966 | Zwickey | 473/582 |
| 4,471,962 | A * | 9/1984 | Godfrey | 473/582 |
| 4,807,382 | A * | 2/1989 | Albrecht | 43/6 |
| 5,046,744 | A | 9/1991 | Eddy | |
| 5,078,407 | A | 1/1992 | Carlston et al. | |
| 5,083,798 | A | 1/1992 | Massey | |
| 5,090,709 | A | 2/1992 | Johnson | |
| 5,100,143 | A | 3/1992 | Puckett | |
| 5,112,063 | A | 5/1992 | Puckett | |
| 5,172,916 | A | 12/1992 | Puckett | |
| 5,178,398 | A | 1/1993 | Eddy | |
| 5,314,196 | A | 5/1994 | Ruelle | |
| 5,458,341 | A | 10/1995 | Forrest | |
| 5,472,213 | A | 12/1995 | Dudley | |
| 5,564,713 | A | 10/1996 | Mizek | |
| 5,570,530 | A | 11/1996 | Lee | |
| 5,803,844 | A | 9/1998 | Anderson | |
| 5,803,845 | A | 9/1998 | Anderson | |
| 5,820,498 | A | 10/1998 | Maleski | |
| 5,857,930 | A | 1/1999 | Troncoso | |
| 5,879,252 | A | 3/1999 | Johnson | |
| 6,015,357 | A | 1/2000 | Rizza | |
| 6,165,086 | A | 12/2000 | Liechty, II | |
| 6,171,206 | B1 | 1/2001 | Liechty, II | |
| 6,200,237 | B1 | 3/2001 | Barrie | |
| 6,217,467 | B1 | 4/2001 | Maleski | |
| 6,258,000 | B1 | 7/2001 | Liechty, II | |
| 6,270,435 | B1 | 8/2001 | Sodaro | |
| 6,283,880 | B1 | 9/2001 | Barrie | |
| 6,287,223 | B1 | 9/2001 | Liechty, II | |
| 6,322,464 | B1 | 11/2001 | Sestak | |
| 6,517,454 | B2 | 2/2003 | Barrie | |

(Continued)

FOREIGN PATENT DOCUMENTS

| | | |
|---|---|---|
| CA | 2075522 | 2/1993 |

(Continued)

*Primary Examiner* — John Ricci
(74) *Attorney, Agent, or Firm* — Holland & Hart

(57) ABSTRACT

An arrow point includes a base portion, a tip portion, and a plurality of extension members. The plurality of extension members each have a distal end, a proximal end, and a blunt surface. The proximal end of the extension members is pivotally mounted to the base portion. The extension members are movable upon proximal movement of the tip portion between a retracted position wherein the blunt surface is unexposed, and an extended position wherein the blunt surface is exposed and facing in a generally distal direction.

20 Claims, 17 Drawing Sheets

U.S. PATENT DOCUMENTS

| | | | | |
|---|---|---|---|---|
| 6,554,727 | B1 | 4/2003 | Armstrong | |
| 6,595,881 | B1 | 7/2003 | Grace, Jr. | |
| 6,669,586 | B2 | 12/2003 | Barrie | |
| 6,743,128 | B2 | 6/2004 | Liechty, II | |
| 6,793,596 | B1 | 9/2004 | Sullivan et al. | |
| 6,830,523 | B1 | 12/2004 | Kuhn | |
| 6,935,976 | B1 | 8/2005 | Grace, Jr. | |
| 7,178,462 | B2 | 2/2007 | Beasley | |
| 7,226,375 | B1 | 6/2007 | Sanford | |
| 7,234,220 | B1 | 6/2007 | Grace, Jr. | |
| 7,311,621 | B2 | 12/2007 | Sullivan et al. | |
| 7,311,622 | B1 * | 12/2007 | Futtere | 473/583 |
| 7,314,419 | B2 * | 1/2008 | Grace et al. | 473/583 |
| 7,377,869 | B2 * | 5/2008 | Wohlfeil et al. | 473/583 |
| 7,393,295 | B1 * | 7/2008 | Futtere | 473/583 |
| 2007/0037640 | A1 | 2/2007 | Rager | |
| 2007/0161438 | A1 | 7/2007 | Fulton | |
| 2008/0045363 | A1 | 2/2008 | Pulkrabek | |
| 2008/0102996 | A1 | 5/2008 | Erhard | |
| 2008/0234079 | A1 | 9/2008 | Butcher | |
| 2009/0029811 | A1 | 1/2009 | Bolen, III | |
| 2009/0111621 | A1 | 4/2009 | Mizek | |

FOREIGN PATENT DOCUMENTS

| | | | |
|---|---|---|---|
| CA | 2614446 | A1 | 12/2008 |

* cited by examiner

EXPANDABLE BLUNT ARROW POINT APPARATUS AND METHODS

TECHNICAL FIELD

The present disclosure relates generally to arrows and arrow components, and more particularly relates to blunt arrow points.

BACKGROUND

Various types of arrow points have been utilized over the years. A broadhead is one common type of arrow point. A typical broadhead includes a pointed tip, a body portion, and razor-sharp broadhead blades which may sometimes be referred to as bleeder blades. The broadhead blades are arranged around the body portion between the pointed tip and the shaft of the arrow. Although broadheads are commonly used to bowhunt big game animals, they are less commonly used for hunting small game, such as groundhogs, rabbits, raccoons, opossums, and squirrels and even some types of game birds. There are many reasons why broadheads are not ideal for small game, including the common occurrence of complete penetration of the arrow through the small game animal. When complete penetration occurs, much of the kinetic energy is wasted because the arrow simply passes through the small game animal. With small game, the more kinetic energy that may be imparted directly to and absorbed by the small game animal, the more likely the animal will expire quickly and recovered more readily.

Blunt arrow points are more commonly used for small game. Blunt arrow points are constructed to render a complete passthrough of the arrow less likely. Traditional blunt points include, without limitation, judo points and rubber blunts. Blunt points are effective on small game because most of the kinetic energy of the arrow is imparted directly to the small game. Traditional blunt arrow points suffer, however, from a number of drawbacks. For example, the relatively larger size (as compared to an arrow shaft diameter and other types of arrow points) result in reduced aerodynamic efficiency. This, in return, results in relatively poor arrow flight and, accordingly, relatively poor accuracy.

In view of the foregoing, there is a need for improved "blunt" arrow point designs that address these and other shortcomings in the art.

SUMMARY

One aspect of the present disclosure relates an arrow point that includes a base portion, a tip portion, and a plurality of extension members. The base portion has a proximal end adapted for connection to an arrow shaft. The tip portion is mounted to the base portion and defines a distal end of the arrow point. Each of the plurality of extension members has a distal end, a proximal end, and a blunt surface. The proximal end of the extension members is pivotally mounted to the base portion. The extension members are movable between a retracted position wherein the blunt surface is unexposed, and an extended position wherein the blunt surface is exposed and facing in a generally distal direction.

The tip portion may be axially movable relative to the base portion. The tip portion may contact the extension members when in the retracted position. Axial movement of the tip portion in a proximal direction may cause the extension members to move from the retracted position toward the extended position. The tip portion may include a shaft that extends into the base portion, and a point positioned at a distal end include a shaft that extends into the base portion, and a point positioned at a distal end of the shaft. The shaft may have a smaller maximum outer dimension than a maximum outer dimension of the point. The blunt surface may face the orthogonal axis of the shaft in the retracted position, and face generally perpendicular to the orthogonal axis of the shaft in the extended position.

The extensions may be oriented generally parallel with a length dimension of the arrow point in the retracted position, and generally perpendicular to the length dimension in the extended position. The plurality of extensions may include two extension members, wherein the extensions define a continuous circumference of the arrow point when in the retracted position. The plurality of extensions may include three extensions, wherein the extensions define a continuous circumference of the arrow point when in the retracted position. Outer surfaces of the extensions may define a surface that tapers toward the tip portion when the extension members are in the retracted position.

The arrow point may further include a plurality of attachment pins configured to releaseably connect the extension members to the base portion. The attachment pins may include a locking portion and a pivot portion, wherein the locking portion is configured to retain the attachment pin in the base portion, and the pivot portion defines a pivot axis about which the extensions pivot. The arrow point may also include an extension member retainer positioned radially adjacent to a portion of the plurality of extensions. The extension member retainer may be removable from the radially adjacent position when the extension members move from the retracted position to the extended position.

Another aspect of the present disclosure is directed to an arrow point adapted to be secured to an end of an arrow shaft. The arrow point includes a tip portion and a plurality of blunt extension members. Each extension member may include a distal end and a proximal end. The extension members are pivotable about the proximal end to orient a blunt surface of the extension member in a generally distal facing direction.

The tip portion may be movable in a proximal direction relative to the arrow shaft, and proximal movement of the tip portion pivots the extension members. The extension members may be pivotable from a retracted position in which the blunt surface is oriented in a radially inward facing direction, and an extended position wherein the blunt surface is oriented in a generally distal facing direction. Each extension member may include a plurality of blunt surfaces that face in the generally distal direction when in the extended position. The tip portion may define a first cam surface that faces generally in a proximal direction, and the extension members may each define a second cam surface that faces generally in a distal direction. The tip portion may be moveable in the proximal direction to contact the first cam surface with the second cam surface thereby pivoting the extension members toward the extended position.

Another aspect of the present disclosure relates to an arrow assembly that includes an arrow shaft and an arrow point, wherein the arrow point is mounted to the arrow shaft. The arrow point includes a plurality of blunt extension members having proximal and distal ends and being pivotally mounted to the arrow point at the proximal end. The distal end may be movable between a retracted position wherein the blunt extension members define a tapered outer surface of the arrow point, and an extended position wherein the distal ends are positioned radially outward and a blunt surface of the blunt extension members is exposed.

The arrow point may further comprise a base portion to which the blunt extension members are pivotally mounted, and a slidable tip portion that moves the blunt extension members from the retracted position to the extended position. The blunt extension members may extend perpendicularly relative to a longitudinal dimension of the arrow point when in the extended position.

A still further aspect of the present disclosure is directed to a method of operating an expandable arrow point. The method may include providing an arrow point having a base portion, a plurality of extension members, and a tip portion, wherein the extension members are pivotally mounted to the base portion at a proximal end of the extension members, and the extension members define a blunt surface. The method may also include arranging the extension members in a retracted position with a distal end of the extension members positioned adjacent to the tip portion and the blunt surface facing radially inward. The method may further include moving the tip portion proximally, wherein proximal movement of the tip portion pivots the extension members toward an extended position to expose the blunt surface. The extended position may orient the blunt surface facing in a generally distal direction.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the present disclosure.

Figure 2:
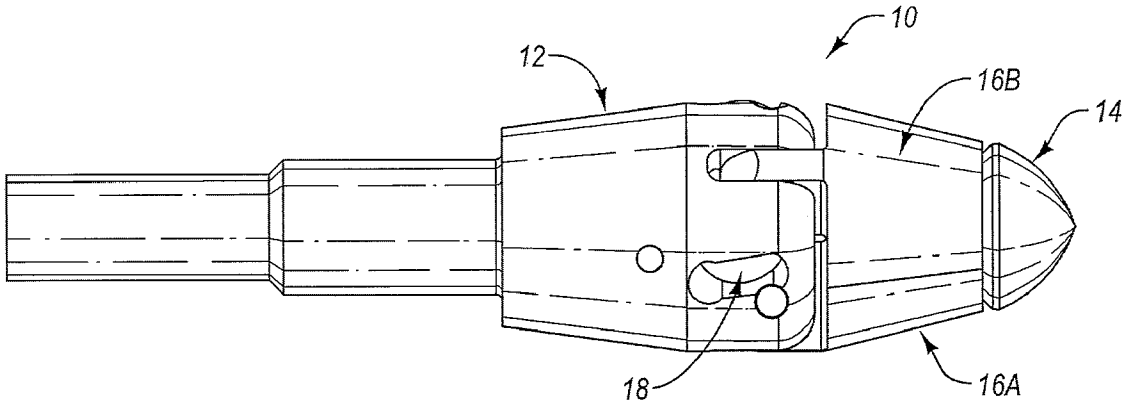
FIG. 2 is a side view of the arrow point of FIG. 1.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of skill in the art will understand that the exemplary embodiments described herein are not intended to be limited to the particular forms disclosed. Rather, the instant disclosure covers all modifications, equivalents, and alternatives falling within the scope defined by the appended claims.

DETAILED DESCRIPTION

Hunting small game and fowl with an archery bow poses some unique challenges. For example, many types of arrow points (e.g., broadheads) used for larger animals have several disadvantages when used for small game and fowl, as set forth above.

Blunt arrow points have been adapted for use with small game and fowl. Use of a blunt portion on the arrow point may reduce the risk of the arrow passing through the small game or fowl. Blunt arrow points are often easier to find after shooting because they do not penetrate targets, brush, foliage, etc. as easily. Arrow points having blunt portions may also be more effective at transferring the kinetic energy of the arrow to the animal or bird, thus creating a shock or stun effect on the target that may be helpful for recovery. Blunt features on an arrow point may also be less aerodynamic than broadhead arrow points. The less aerodynamic an arrow point, the less accurately the arrow flies.

The present disclosure is directed to an arrow point that has a relatively low profile, aerodynamic shape during flight. The arrow point includes expandable extension members to cause the blunt arrow point to assume a different configuration upon contacting the target. The arrow point in an expanded configuration includes a plurality of blunt extension members that maximize the transfer of kinetic energy of the arrow to the target.

In one example, the expandable arrow point includes a tip portion and a plurality of movable blunt projections or blunt extension members to limit penetration of the arrow. The tip portion is moveable in the proximal direction upon contacting the target. The movable extension members may be pivotable arms that move into a penetration limiting configuration. Proximal movement of the tip portion automatically extends the extension members from a retracted orientation into an expanded, radially outward extending position. When the extension members are oriented in the expanded position, a plurality of blunt surfaces are exposed. Contact of the blunt surfaces with the target enhance the transfer of the kinetic energy from the arrow to the target. The extension members in the expanded position may also inhibit penetration of the expandable arrow point into the target. Typically, when the extension members are in the expanded position the expandable arrow point has an increased outer profile and surface area facing in the distal direction for contact with the target.

In at least one arrangement, the extension members in the expanded position are arranged generally perpendicularly relative to a longitudinal axis of the arrow. The extension members may be pivotal about a proximal end portion of the extension members. That is, when the extension members are in the retracted position a distal end portion of the extension members are positioned adjacent to a point of the tip portion and the proximal end portion of the extension members are pivotally mounted to the expandable arrow point. Upon movement of the tip portion in the proximal direction, the extension members rotate about the pivot point at the proximal end portion to move the distal end portion of the extension members in the proximal direction and radially outward orientation to expose the blunt surfaces of the extension members.

The example expandable arrow point disclosed herein may have different numbers of extension members. In one example, a single pair of extension members are used. In other arrangements, three or more extension members are used. When the extension members are in the retracted position, an outer surface of the extension members is exposed. The outer surface of the extension members may define a tapered surface that improves aerodynamic properties of the expandable arrow point during flight.

The extension members may be secured to a base portion of the expandable arrow point with an attachment pin. The attachment pin may be removable to provide replacement of the extension members. The tip portion of the expandable arrow point may also be removably mounted to the base portion. A retaining member (e.g., an O-ring) may be mounted on an exterior surface of the expandable arrow point to retain the extension members in the retracted or closed position during stowage and flight, and permit movement of the extension members when the tip portion contacts a target. After use of the expandable arrow point (i.e., contacting the target and movement of the extension members into the expanded position), the expandable arrow point may be reused by advancing the tip portion distally and pivoting the extension members back into the retracted position.

The entire expandable arrow point may be removably mounted to an arrow shaft. The arrow shaft may have any shape or size (e.g., diameter and length). In one example, a base portion of the expandable arrow point includes a threaded shaft or shank that engages a threaded bore of an arrow outsert or insert, or arrow shaft. The expandable arrow point may be constructed to mount at least in part to or over an outer surface of the arrow shaft. The expandable arrow point may include at least one blade having a cutting edge. One aspect of the present disclosure relates to an arrow that includes a shaft and an expandable arrow point having those features disclosed herein.

Figure 3:
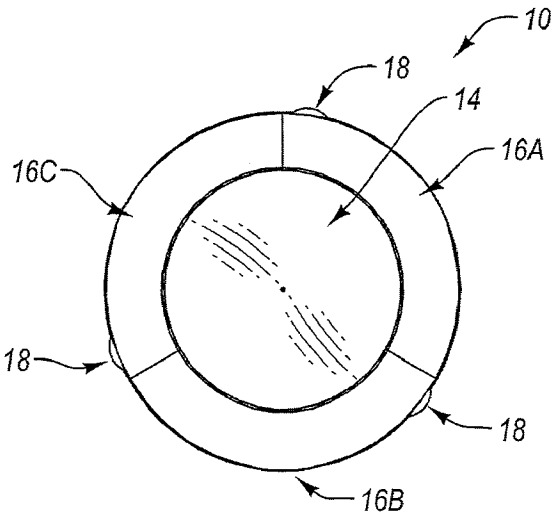
FIG. 3 is an end view of the arrow point of FIG. 1.
Figure 1:
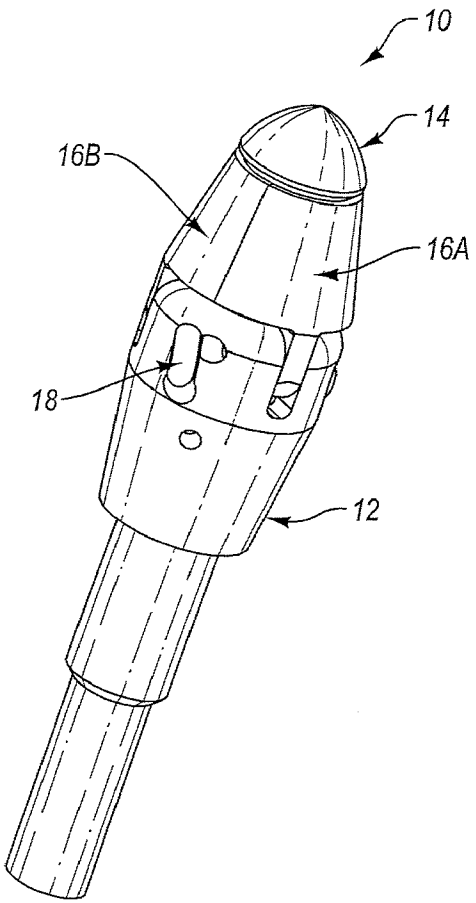
FIG. 1 is a perspective view of an example expandable arrow point in accordance with the present disclosure, the arrow point having three extension members in a retracted position.
Figure 5:
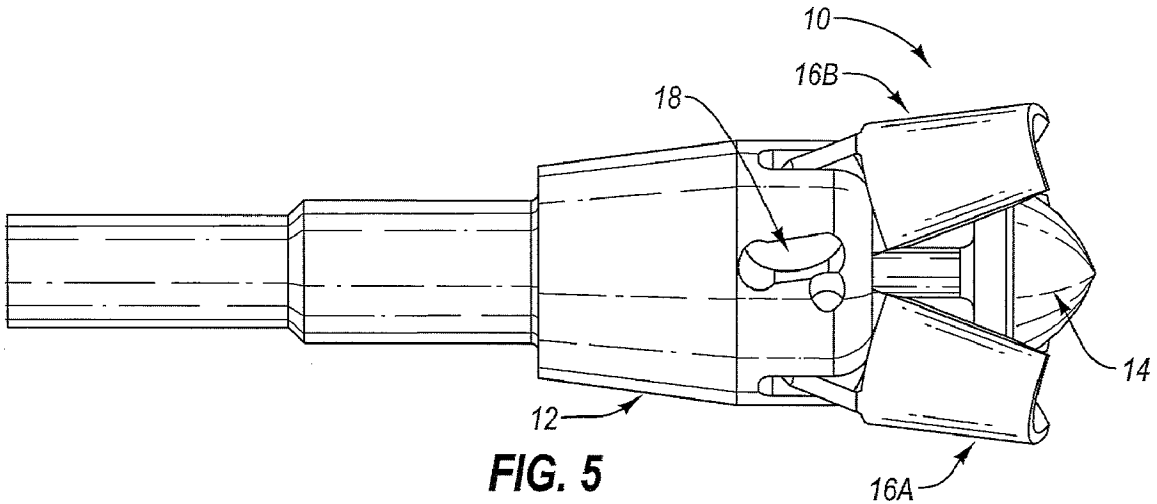
FIG. 5 is a side view of the arrow point shown in FIG. 4.
Figure 6:
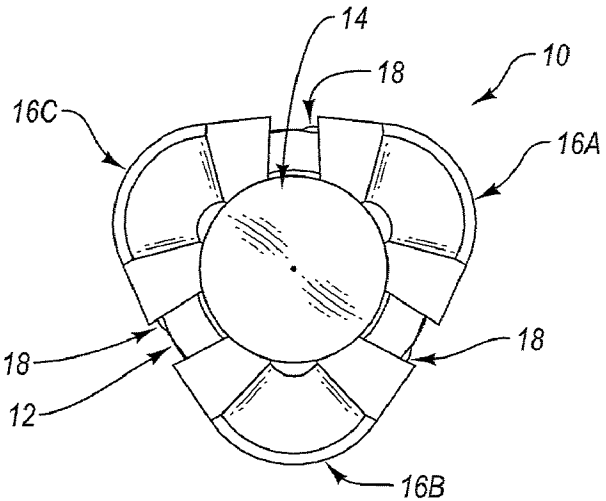
FIG. 6 is an end view of the arrow point shown in FIG. 4.
Figure 4:
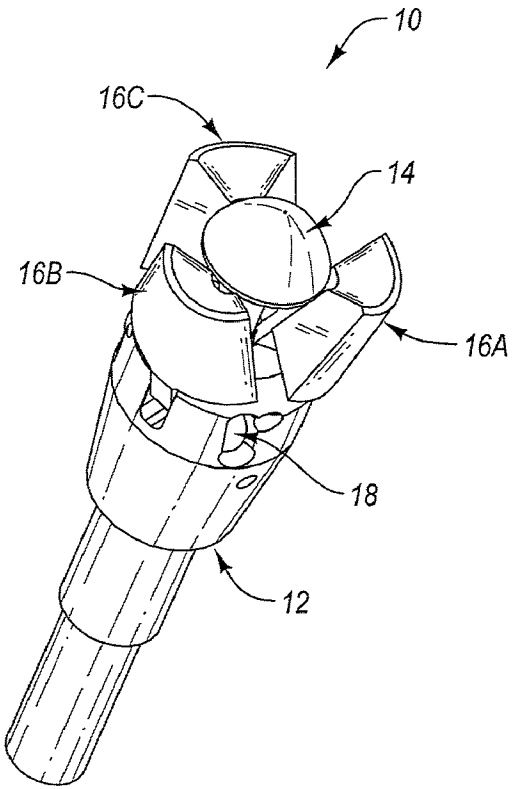
FIG. 4 is a perspective view of the arrow point of FIG. 1 with the extension members in a partially extended position.
Figure 8:
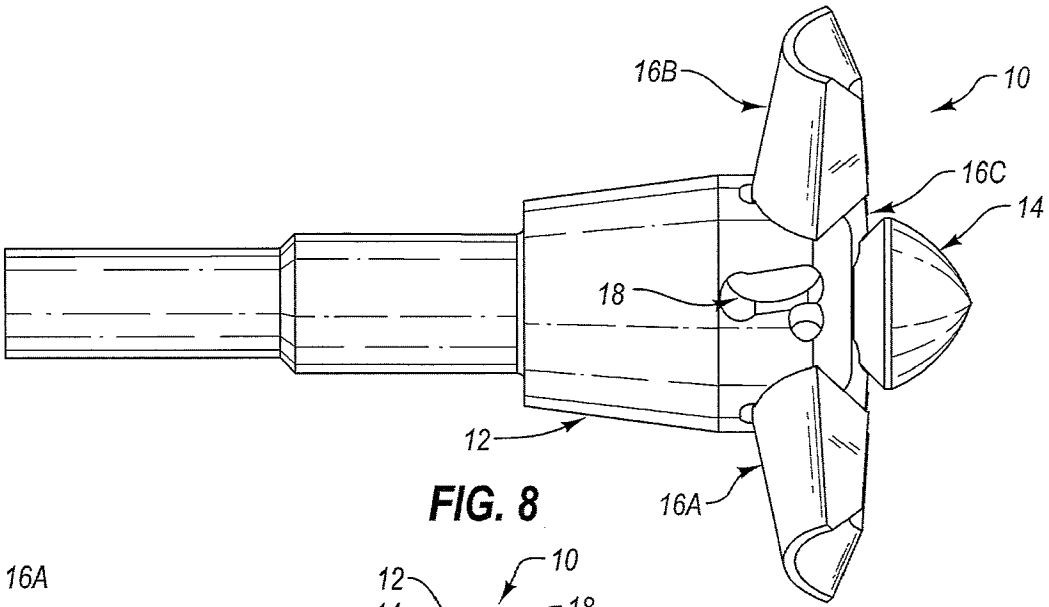
FIG. 8 is a side view of the arrow point shown in FIG. 7.
Figure 9:
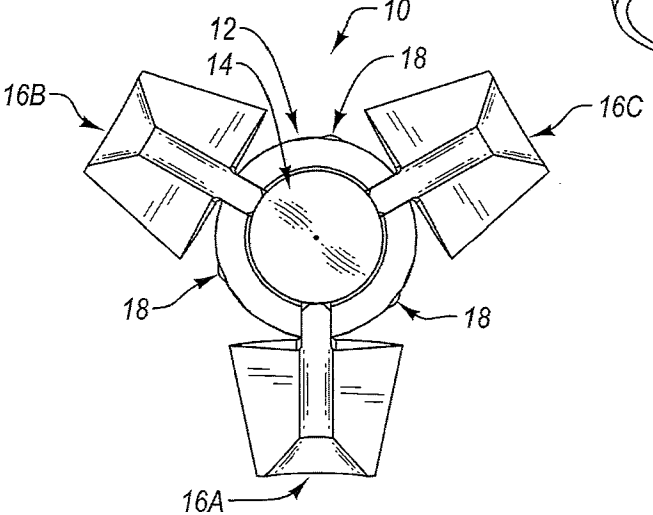
FIG. 9 is an end view of the arrow point shown in FIG. 7.
Figure 7:
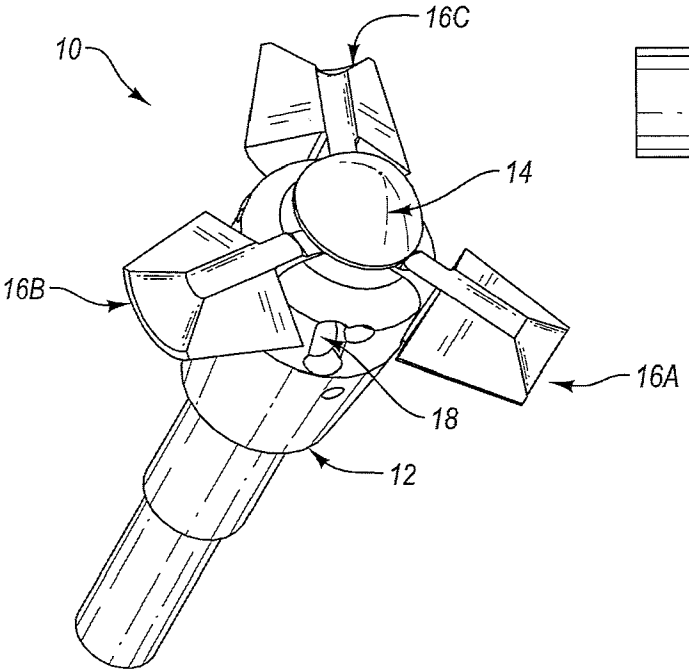
FIG. 7 is a perspective view of the arrow point of FIG. 1 with the extension members in a fully extended position.
Figure 11:
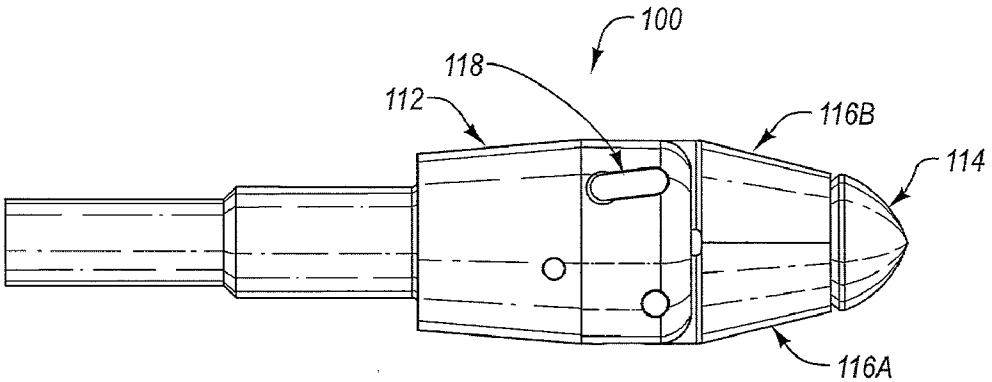
FIG. 11 is a first side view of the arrow point shown in FIG. 10.
Figure 12:
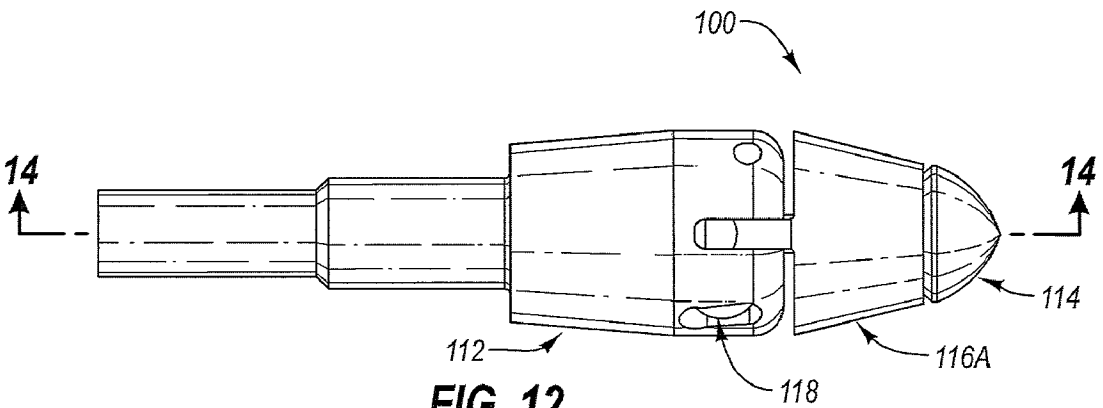
FIG. 12 is a second side view of the arrow point shown in FIG. 10.
Figure 10:
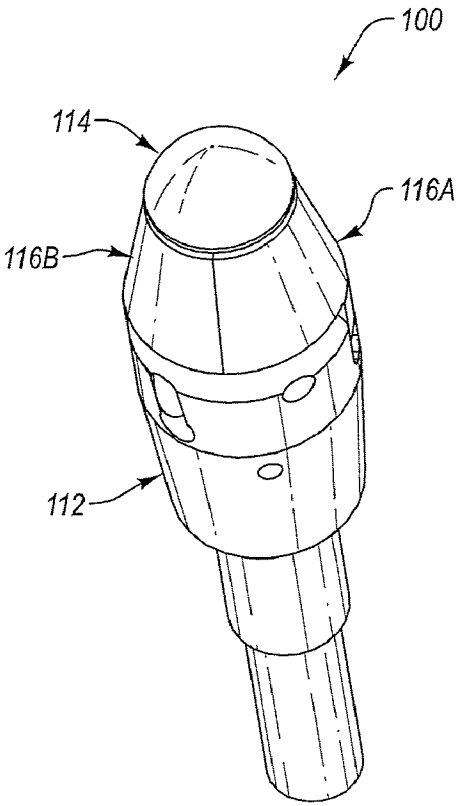
FIG. 10 is a perspective view of another example expandable arrow point in accordance with the present disclosure, the arrow point having two extension members in a retracted position.

Referring now to FIGS. 1-9 and 24-32, an example expandable arrow point 10 is shown and described. The arrow point 10 includes a base portion 12, a tip portion 14, a plurality of extension members 16A-C, and a plurality of attachment pins 18. The arrow point 10 is shown in FIGS. 1-3 in an unexpanded position with the extension members in a retracted orientation. FIGS. 4-6 illustrate the arrow point 10 in a partially expanded position with the extension members in a pivoted position between unexpanded and fully expanded positions. FIGS. 7-9 show the arrow point 10 in a fully expanded position with the extension members pivoted into a fully extended position. The extension members 16A-C shown in FIGS. 7-9 are arranged generally perpendicular to a longitudinal axis (i.e., a length dimension) of the arrow point 10.

Movement of the tip portion 14 in a proximal or rearward direction relative to the position shown in FIGS. 1-3 may causes a surface of the tip portion 14 to contact a distal portion of the extension members 16A-C. This contact between the tip portion 14 and extension members 16A-C causes the extension members 16A-C to pivot about a pivot point at a proximal end of the extension members 16A-C. The distal ends of the extension members 16A-C rotate in a radially outward and proximal direction into the partially extended position shown in FIGS. 4-6. Further pivotal motion of the extension members 16A-C towards the fully extended position shown in FIGS. 7-9 occurs due to at least one of the tip portion 14 moving further in the proximal or rearward direction (i.e., compare FIGS. 4-6 to FIGS. 7-9), or the exposed proximal portion of the extension members 16A-C along a distal facing surface of the extension members 16A-C contacting the target.

In at least some arrangements, the extension members 16A-C are movable between the retracted and extended positions independent of the tip portion 14. As a result, the extension members 16A-C may move between retracted and extended positions without the tip portion 14 moving in the proximal or rearward direction. However, during actual use of the expandable arrow point 10, the extension members 16A-C are typically configured to maintain the retracted position shown in FIGS. 1-3 at all times, including during flight of the arrow carrying the expandable arrow point 10, until the tip portion 14 contacts the target and begins to move in the proximal or rearward direction.

Referring now to FIGS. 24-32, the individual components of expandable arrow point 10 are described in further detail. First referring to FIGS. 24-26, the base portion 12 includes an extension member support 20 and a shank 22. Extension member support 20 includes a plurality of extension member openings 24, a plurality of pivot member openings 26, a plurality of biasing member openings 28, and a distal surface 32. The extension member support 20 may have a maximum outer dimension $D_1$ (see FIG. 25).

Extension member openings 24 are sized to receive proximal portions of the extension members 16A-C. Extension member openings 24 may define a pathway within which the extension members 16A-C travel. A portion of the extension member openings 24 may define a position stop for the extension members 16A-C in the fully extended position.

Figure 31:
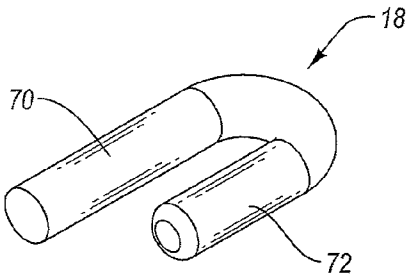
FIG. 31 is a perspective view of an attachment pin of the arrow point shown in FIGS. 1 and 10.
Figure 32:
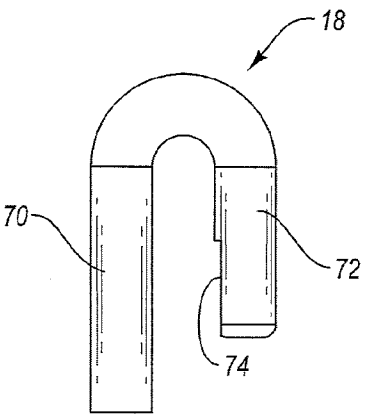
FIG. 32 is a side view of the attachment pin shown in FIG. 30.

The pivot member opening 26 is sized to receive a pivot leg 70 (also referred to as a pivot portion or pivot member) of the attachment pins 18 (see FIGS. 31 and 32). The pivot member opening 26 may have a substantially similar size (e.g., diameter) as a size of the pivot leg 70. In some arrangements, the pivot leg 70 is maintained in the pivot member opening 26 with an interference fit. The pivot member opening 26 may be positioned as close to a rear or proximal end surface of the extension members 16A-C as possible to maximize the distance the extension members 16A-C extend radially outward when in the fully extended position.

The biasing member opening 28 is sized to receive a biasing leg 72 (also referred to as a biasing portion or biasing member) of the attachment pins 18. The biasing member opening 28 typically has a greater size (e.g., diameter) than a size of the biasing leg 72 that is positioned in the biasing member opening 28. This larger size permits radial or lateral movement of the biasing leg 72 within the biasing member opening 28 as will be described in further detail herein.

Extension member support 20 has a proximal portion 30 that tapers in the proximal or rearward direction. This tapered construction may provide additional aerodynamics for the base portion 12. Other constructions are possible for the extension member support 20.

Figure 37:
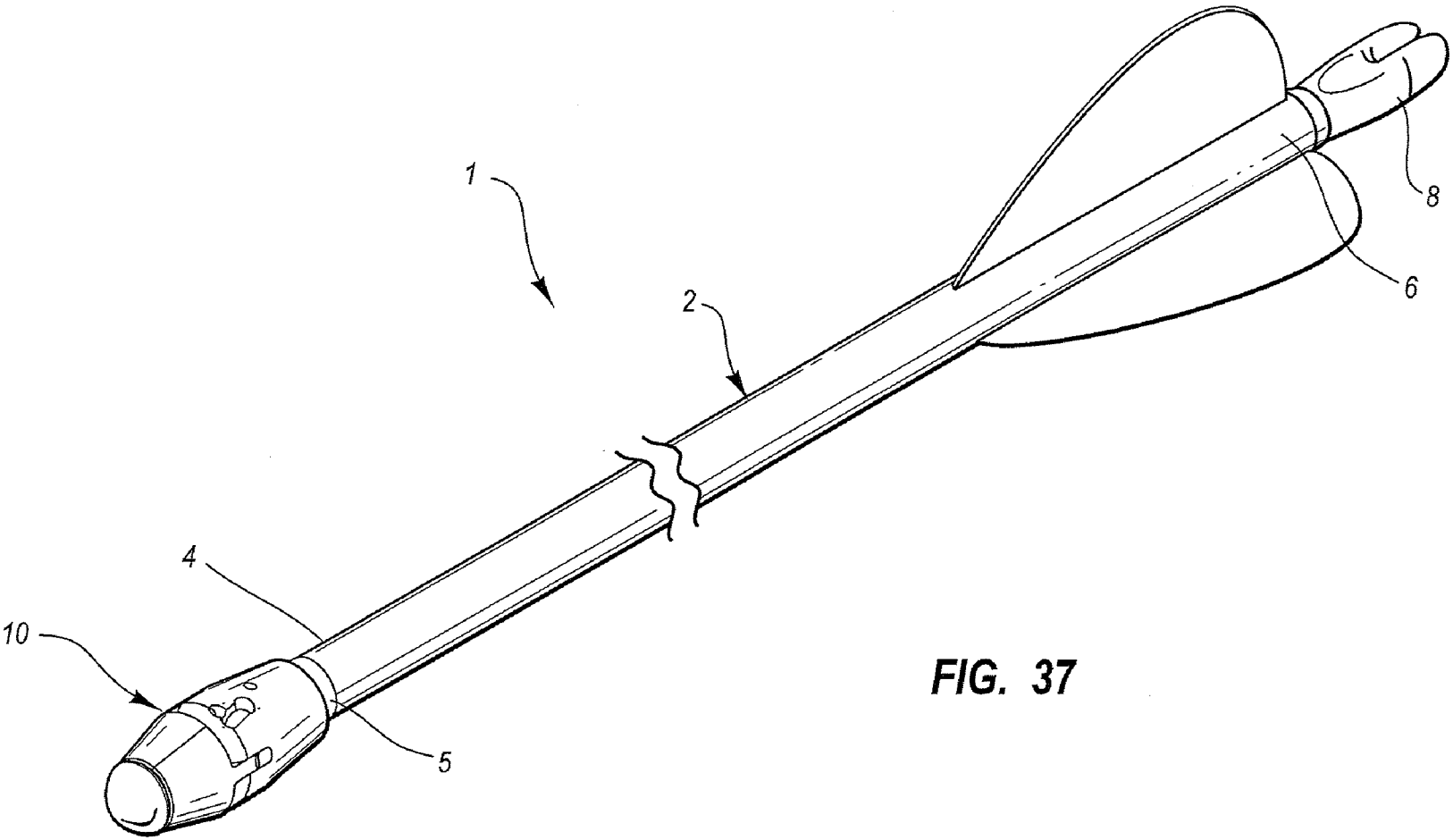
FIG. 37 is a perspective view of an example arrow assembly having the arrow point of FIG. 1 mounted to an arrow shaft.

The shank 22 is constructed to connect the arrow point 10 to an arrow shaft. FIG. 37 illustrates an arrow assembly 1 having the arrow point 10 mounted to a distal end 4 of an arrow shaft 2. The arrow assembly 1 also includes a nock 8 mounted at a proximal end 6 of the arrow shaft. The shank 22 may be sized for insertion into an inner cavity of the arrow shaft 2. The shank 22 may include a threaded portion 34 that threadably engages a threaded bore of the arrow shaft 2 or an insert 5 mounted within the arrow shaft 2. In other constructions, at least a portion of the shank 22 or other portion of the expandable arrow point 10 may extend around or contact an outer surface of the arrow shaft 2.

Figure 23:
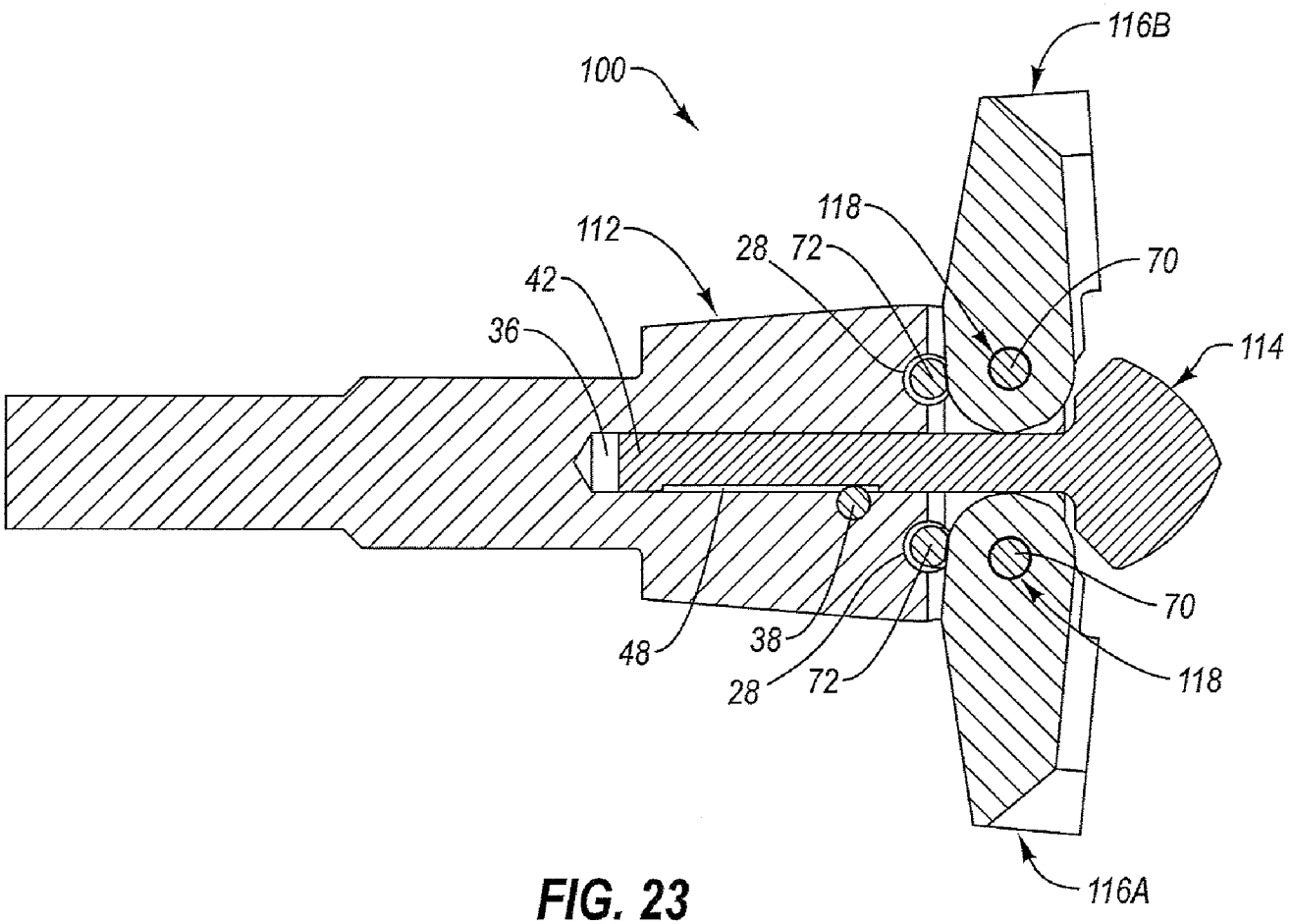
FIG. 23 is a cross-sectional view of the arrow point shown in FIG. 20 taken along cross-section indicators 23-23.
Figure 25:
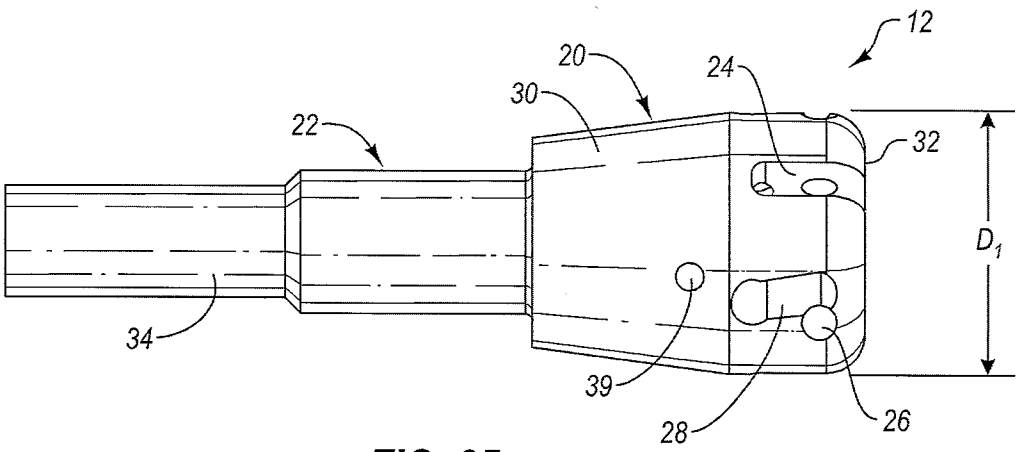
FIG. 25 is a side view of the base portion shown in FIG. 24.
Figure 26:
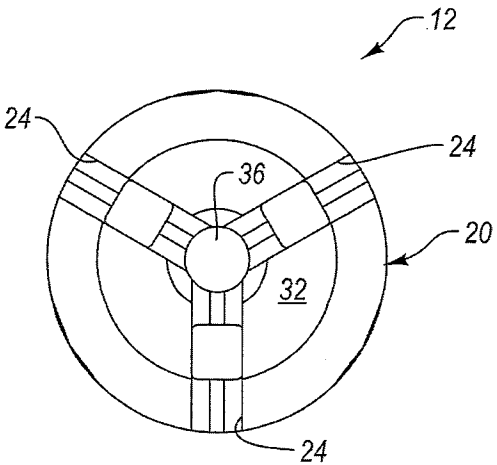
FIG. 26 is an end view of the base portion shown in FIG. 24.
Figure 24:
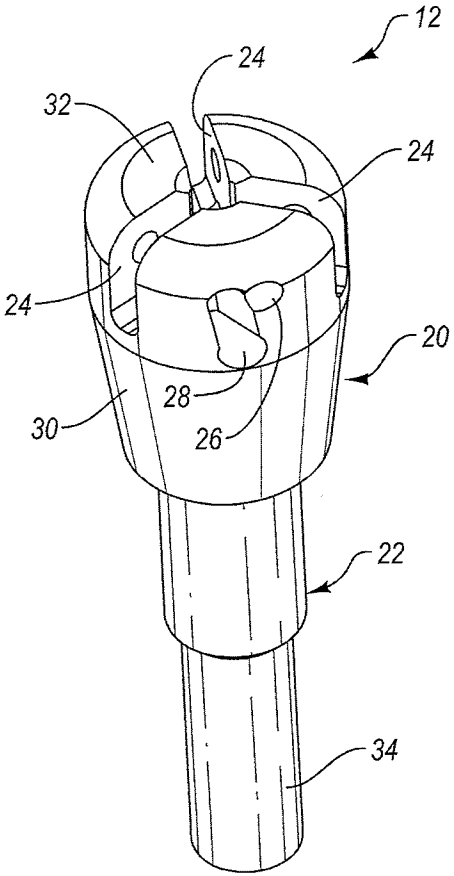
FIG. 24 is a perspective view of the base portion of the arrow point shown in FIG. 1.

The base portion 12 may also include a tip aperture 36 that receives the tip portion 14 (see FIG. 26). The base portion 12 may also include a tip retention pin 38 (see FIGS. 14 and 23) that is received in a tip retention aperture 39 (see FIG. 25). The tip retention pin 38 may contact the tip portion 14 to retain the tip portion 14 within the tip aperture 36. The tip retention pin 38 may be removable to facilitate replacement of the tip portion 14 from the expandable arrow point 10. Other structures may be used in addition to or in place of the tip retention pin 38 to help retain the tip portion 14 assembled with the base portion 12.

Figure 28:
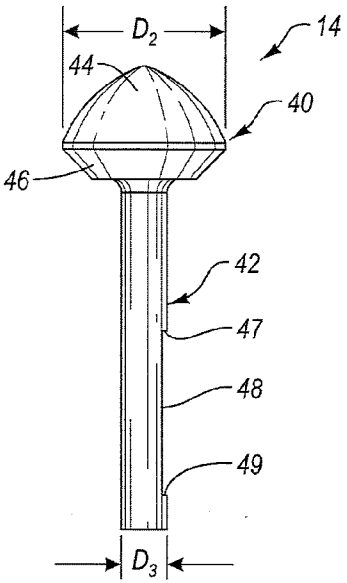
FIG. 28 is a side view of the tip portion shown in FIG. 27.
Figure 27:
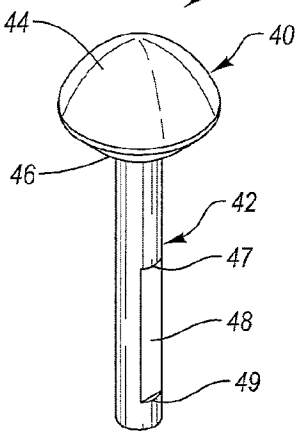
FIG. 27 is a perspective view of an tip portion of the arrow point shown in FIGS. 1 and 10.

The tip portion 14 is shown in further detail with reference to FIGS. 27-28. The tip portion 14 includes a point 40 and a shaft 42. The point 40 includes a distal surface 44 and a proximal surface 46 (also referred to herein as a tip cam surface). The point 40 may have a maximum outer dimension $D_2$ (see FIG. 28). The distal surface 44 is shown having a generally contoured shape. Many other shapes, sizes, and constructions are possible for the point 40 that define distal surfaces 44. For example, the point 40 may have a generally pointed construction wherein the distal surface 44 includes a plurality of planar surfaces or a continuous conical surface.

The proximal surface 46 may face in a generally proximal or rearward direction. The proximal surface 46 may be defined by a continuous conical structure positioned proximal or rearward of the distal surface 44. The proximal surface 46 may be arranged to face a portion of the extension members 16A-C when the extension members are in a retracted position. In at least some arrangements, the proximal surface 46 is arranged parallel with and facing a cam surface of the extension members 16A-C (see, e.g. FIG. 14).

The shaft 42 may include a retention portion or cutout 48. The retention portion 48 may be sized and arranged to permit a portion of the tip retention pin 38 to be inserted therein (see, e.g., FIG. 14). Distal and proximal end surfaces 47, 49 of the retention portion 48 may provide position stops for proximal and distal travel of the tip portion 14 relative to the tip retention pin 38 positioned in the tip retention pin aperture 39 of the base portion 12. Many other devices and constructions are possible to help retain the tip portion 14 assembled to the base portion 12 while permitting some axial movement of the tip portion 14 relative to the base portion 12.

Figure 29:
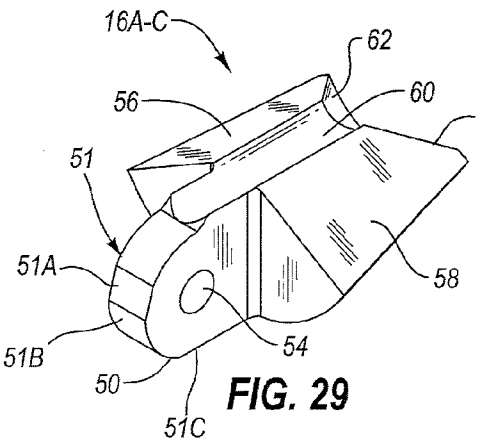
FIG. 29 is a perspective view of a extension member of the arrow point shown in FIGS. 1 and 10.

The extension members 16A-C are shown and described in further detail with reference to FIGS. 29-30. The extension members 16A-C include a proximal end portion 50, a distal end portion 52, and a pivot aperture 54 defined in the proximal end portion 50. The extension members 16A-C further include first and second inner surfaces 56, 58 (also referred to herein as blunt surfaces), a tip shaft contact surface 60, a point contact surface 62 (also referred to herein as an extension member cam surface), and an outer surface 64.

The pivot aperture 54 is sized to receive a portion of the attachment pin 18 to permit pivotal movement of the extension members 16A-C relative to the base portion 12. The extension members 16A-C each include a proximal cam surface 51 having first, second and third portions 51A, 51B, 51C at the proximal end 52. Each of the portions 51A, 51B, 51C is spaced from a central axis of the pivot aperture 54 a distance $R_1$, $R_2$, $R_3$, respectively. The distances $R_1$, $R_2$, $R_3$ may each be different. Typically, the distance $R_1$ is less than the distance $R_2$. The distance $R_3$ may also be less than the distance $R_2$. The distances $R_1$ and $R_3$ may be the same. The difference in size between the distances $R_1$, $R_2$, $R_3$ may influence rotatability of the extension members 16A-C between the various positions shown in, for example, FIG. 14B.

The portions 51A, 51B, 51C may have different shapes and sizes. In one example, the first portion 51A is a generally planar surface, the second portion 51B is a generally contoured surface, and the third portion 51C is a generally planar surface. A transition between the shapes of the first, second and third portions 51A, 51B, 51C may influence rotatability of the extension members 16A-C between the various positions shown in, for example, FIG. 14B.

The first and second inner surfaces 56, 58 and the tip shaft contact surface 60 face generally radially inward when the extension members 16A-C are in the retracted position shown in FIGS. 1-3. The surfaces 56, 58, 60 may be concealed, covered, or unexposed when the extension members 16A-C are in the retracted position. The surfaces 56, 58, 60 may be defined as generally blunt surfaces. The surfaces 56, 58, 60 may be void of cutting features. The surfaces 56, 58, 60 become uncovered, unconcealed, or exposed as the extension members 16A-C move from the retracted position shown in FIGS. 1-3 to the partially and fully extended positions shown in FIGS. 4-6 and 7-9, respectively. The surfaces 56, 58, 60 may contribute to the extension members 16A-C being defined as blunt extension members.

When the extension members 16A-C are in the fully extended position shown in FIGS. 7-9, the surfaces 56, 58, 60 are arranged facing generally distally or in the generally distal direction. Referring to FIG. 9, the extension members 16A-C provide surface area facing in the distal direction when in the extended position. This exposed surface area facing in the distal direction may help maximize the transfer of kinetic energy of the arrow to the target. The exposed surface area of the surfaces 56, 58, 60 facing in the distal direction may also limit penetration of the expandable arrow point 10 into the target.

A comparison of FIGS. 3, 6 and 9 illustrates the increase in surface area exposed in the distal direction as the extension members 16A-C move from the retracted position to the fully expanded position. Movement of the extension members 16A-C from the generally perpendicular orientation shown in FIGS. 6-9 rotated further in the proximal direction may limit the exposed surface area facing in the distal direction. In alternative arrangements, the fully extended position may be at a rotated position that is further in the proximal direction beyond the generally perpendicular orientation shown in FIGS. 6-9 or further in the distal direction before reaching the generally perpendicular orientation.

The point contact surface 62 may be arranged facing the point 40 of the tip portion 14 when the extension members 16A-C are in the retracted position. The point contact surface 62 may be arranged as the surface of the extension members 16A-C that is first contacted by the tip portion 14 as the tip portion 14 moves in the proximal or rearward direction. The point contact surface 62 may be arranged generally parallel to and facing the proximal surface 46 of the point 40. The point contact surface 62 may be referred to as a extension member cam surface because of the interface between the proximal surface 46 of the point 40 and the point contact surface 62 as the tip portion 14 moves in the proximal or rearward direction. The proximal surface 46 of the point 40 may contact other surfaces of the extension members 16A-C as the tip portion 14 moves proximally.

The point contact surface 62 may be arranged facing in a generally distal direction to define at least in part a distal facing surface of the extension members 16A-C as the extension members 16A-C begin to rotate radially outward and proximally. The point contact surface 62 along with a distal surface 66 may be the first surfaces of the extension members 16A-C that contact the target. Point contact surface 62, along with the first and second inner surfaces 56, 58 and tip shaft contact surface 60 may define a surface area facing in the generally distal direction as shown in at least FIGS. 6 and 9. The point contact surface 62 may be defined as a blunt surface.

Figure 30:
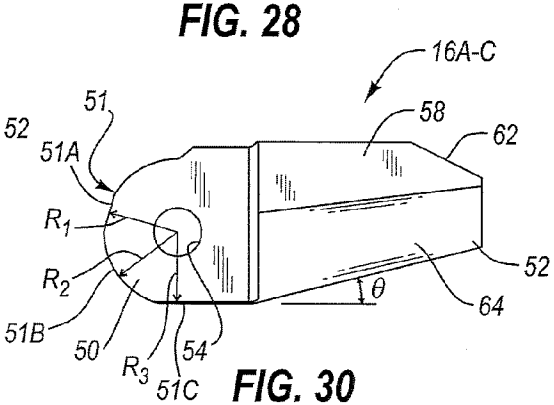
FIG. 30 is a side view of the extension member shown in FIG. 29.

The outer surface 64 of the extension members 16A-C may be arranged at a tapered angle θ (see FIG. 30). The tapered construction of the outer surface 64 may help reduce the profile of expandable arrow point 10 when the extension members 16A-C are in the retracted position. The outer surface 64 may define an aerodynamic shape or a portion of an aerodynamic shape. The outer surface 64 extends from the proximal end portion 50 to the distal end portion 52. In some arrangements, the outer surface 64 may include a plurality of intersecting surfaces and includes at least one contoured or other shaped surface.

Each of the proximal cam surface portions 51A-C relates to a different rotated position of the extension members 16A-C relative to the base portion 12. The first portion 51A relates to an unexpanded position of the extension members 16A-C (see FIGS. 1-3 and 10-14). The second portion 51B relates to a partially expanded position of the extension members 16A-C (see FIGS. 4-6 and 15-17). The third portion 51C relates to a fully expanded position of the extension members 16A-C (see FIGS. 7-9 and 18-22).

Referring now to FIGS. 31 and 32, an attachment pin 18 is shown and described. The attachment pin 18 includes a pivot leg 70 and a biasing leg 72. The biasing leg 72 may include a contact surface 74 that is contacted by the proximal cam surface 51 of the biasing leg 72. The contact surface 74 may be structured as a flat or planar surface formed in the generally contoured outer circumference surface of the locking leg 72. The biasing leg 72 may be used to apply tension to the extension members 16A-C to maintain a given rotated position of the extension members 16A-C. The biasing leg 72 may move relative to the base portion 12.

As the extension members 16A-C rotate between the unexpanded or retracted position (see FIGS. 1-3 and 10-14), partially expanded position (see FIGS. 4-6 and 15-17), and fully expanded position (see FIGS. 7-9 and 18-22), the different portions 51A-C of the proximal cam surface 51 contact the contact surface 74 of the biasing leg 72 to cause the biasing leg 72 to move laterally within the biasing member opening 28. The biasing leg 72 may flex within the biasing member opening 28 in any direction as a result of the difference in size between the biasing member opening 28 and the biasing leg 72.

The biasing leg 72 may apply less of a laterally directed biasing force against the extension members 16A-C when the first and third portion 51A, 51C contact the contact surface 74 of the biasing leg 72 than when the second portion 51B is in contact with the contact surface 74. The biasing force applied by the biasing leg 72 to the extension members 16A-C tends to help hold the extension members 16A-C in the unexpanded position until that biasing force is overcome by rotational forces of the extension members 16A-C caused by axial forces applied to the point 40 that are transferred to the surfaces 60, 62 of the extension members 16A-C to rotate the extension members 16A-C toward the partially expanded and fully expanded positions.

Once the extension members 16A-C rotate past a transition point between the first and second portions 51A-B of the proximal cam surface 51, the extension members 16A-C may more easily rotate to the partially expanded and fully expanded positions. Once the extension members 16A-C rotate into the fully expanded position (e.g., see FIG. 22), a lateral biasing force applied by the biasing leg 72 may need to be overcome in order for the extension members 16A-C to rotate past a transition point between the second and third portions 51B-C and into the partially expanded and unexpanded positions.

Figure 14A:
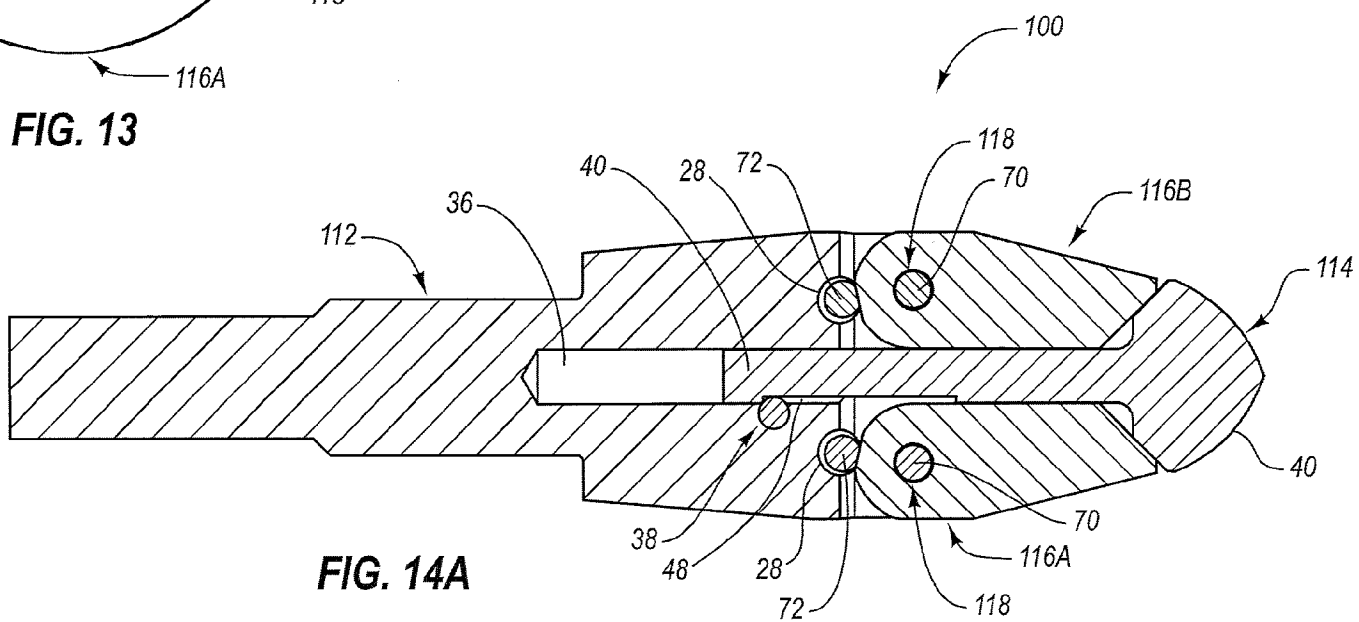
FIG. 14A is a cross-sectional view of the arrow point shown in FIG. 12 taken along cross-section indicators 14-14.
Figure 14B:
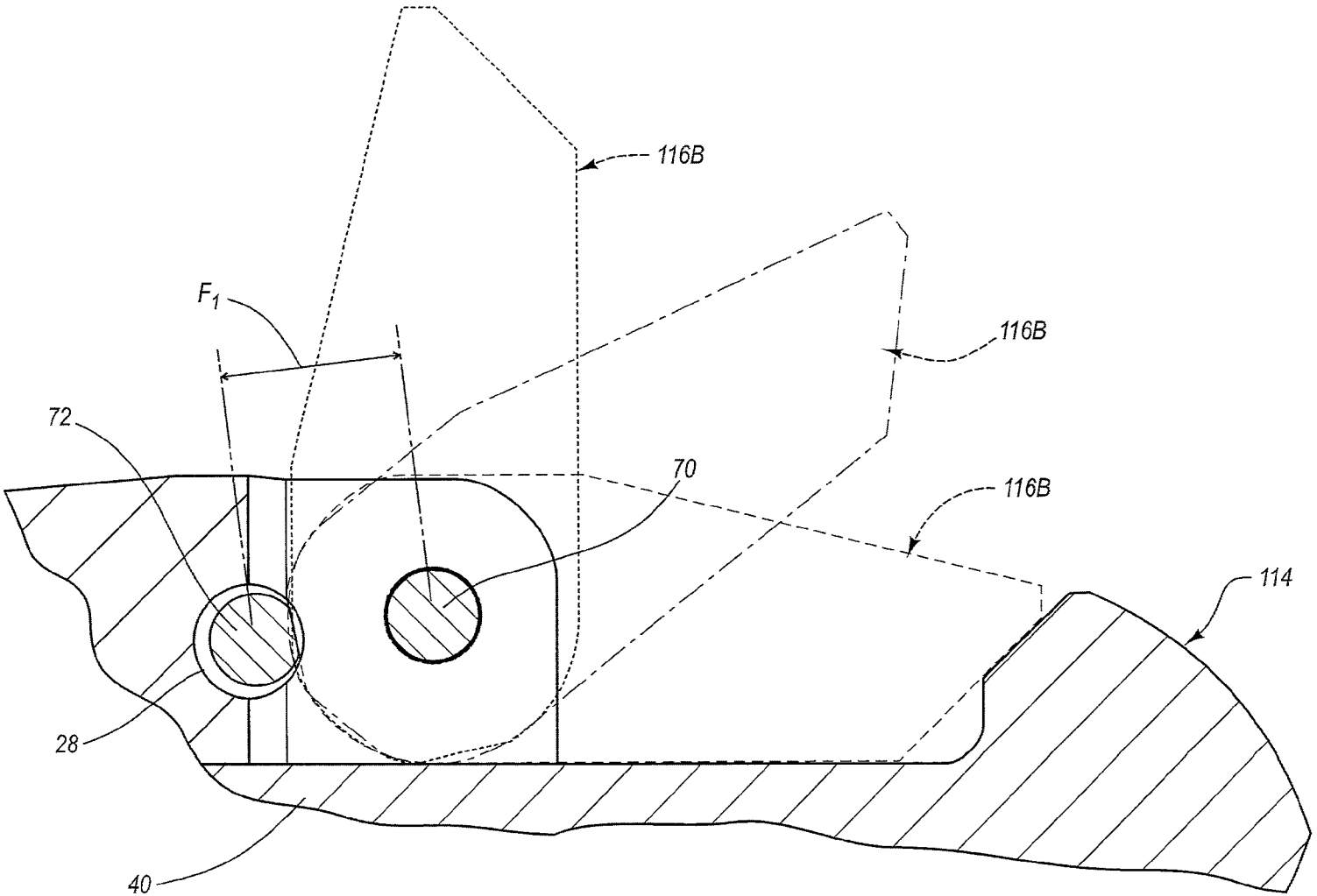
FIG. 14B is a detailed view of a portion of the arrow point shown in FIG. 14A.
Figure 16A:
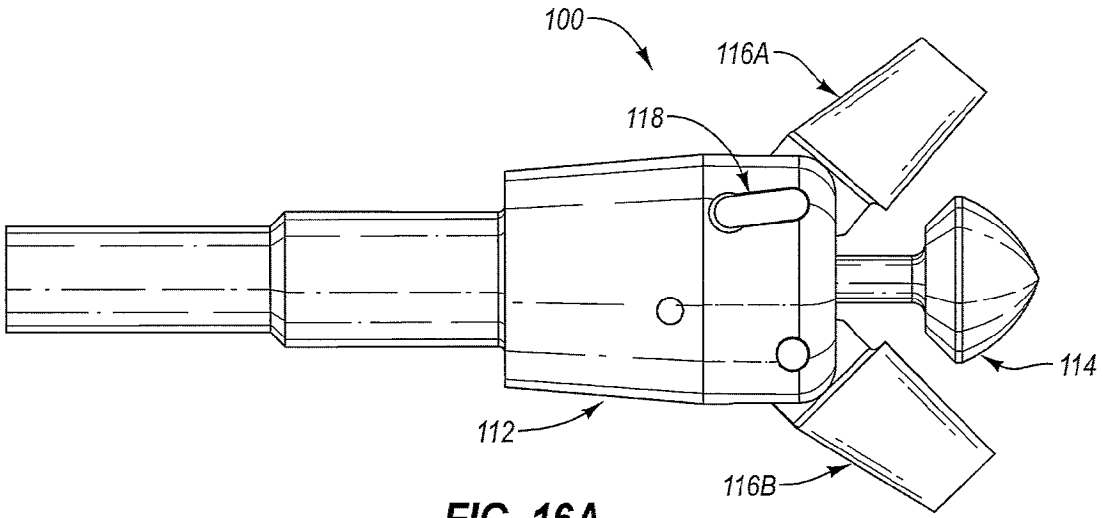
FIG. 16A is a first side view of the arrow point shown in FIG. 15.
Figure 16B:
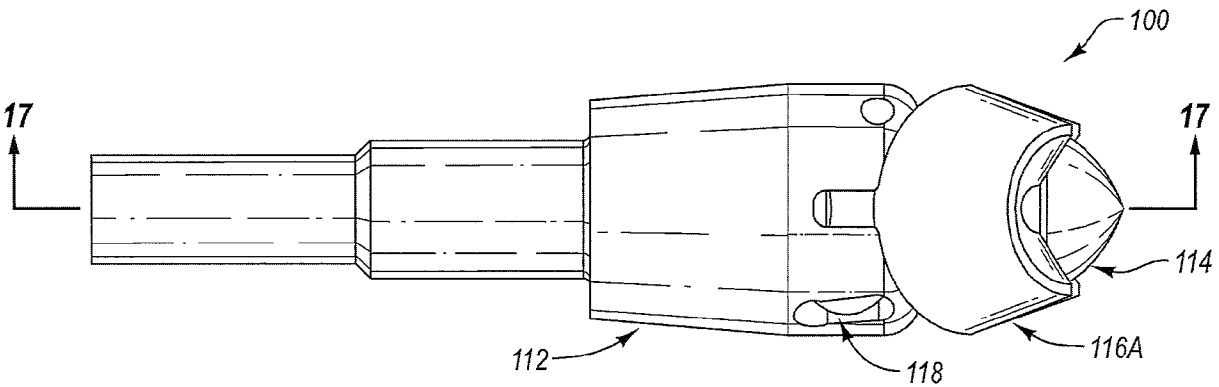
FIG. 16B is a second side view of the arrow point shown in FIG. 15.
Figure 15:
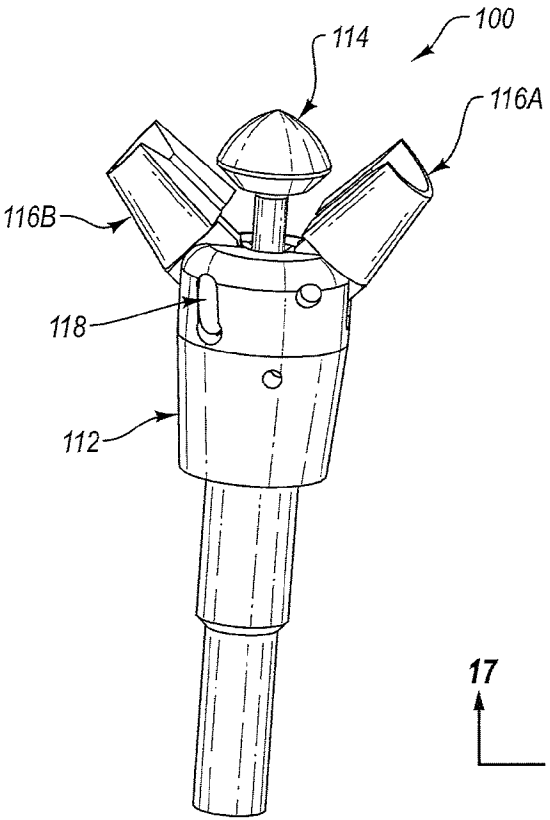
FIG. 15 is a perspective view of the arrow point of FIG. 10 with the extension members in a partially extended position.
Figure 17A:
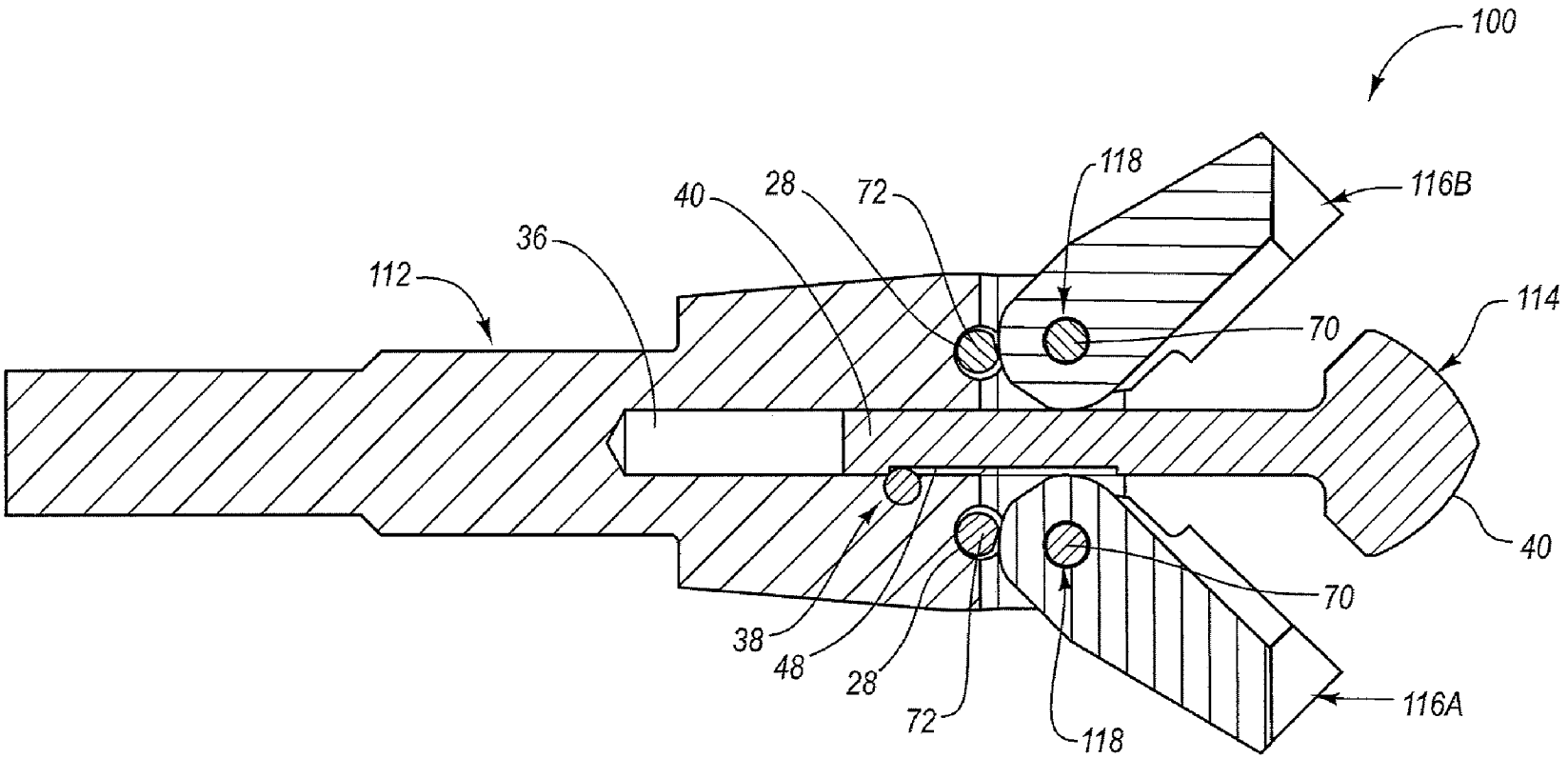
FIG. 17A is a cross-sectional view of the arrow point shown in FIG. 16B taken along cross-section indicators 17-17.
Figure 17B:
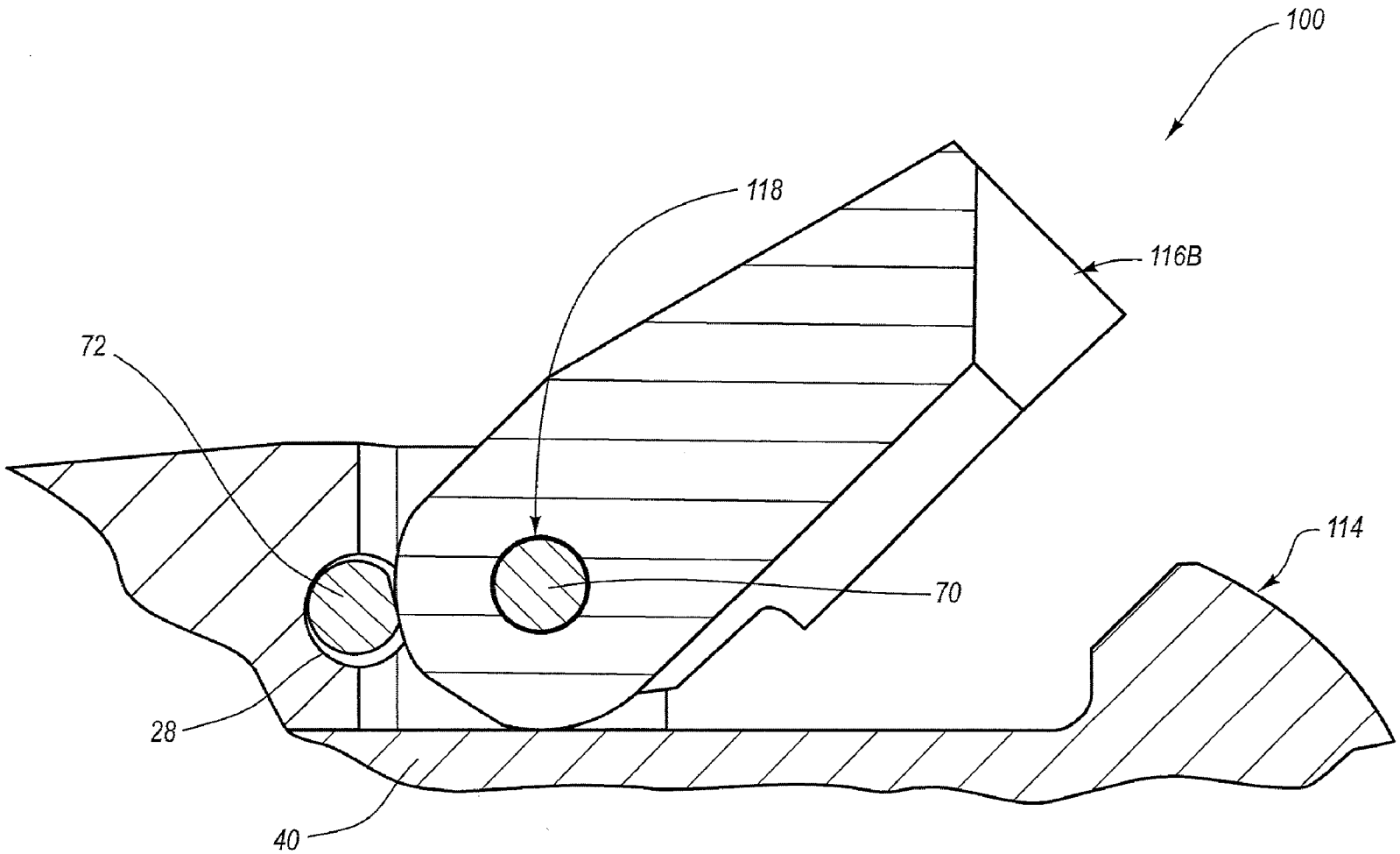
FIG. 17B is a detailed view of a portion of the arrow point shown in FIG. 17A.
Figure 19:
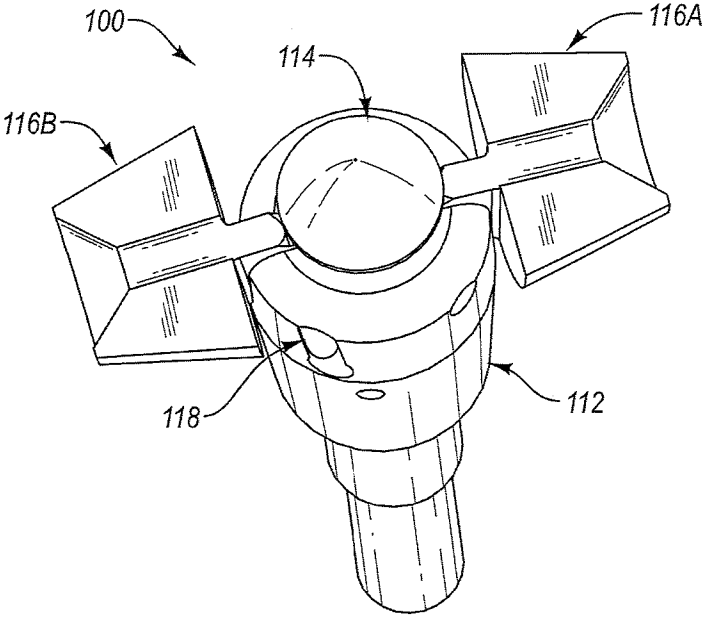
FIG. 19 is a perspective view of the arrow point of FIG. 10 with the extension members in a full extended position.
Figure 20:
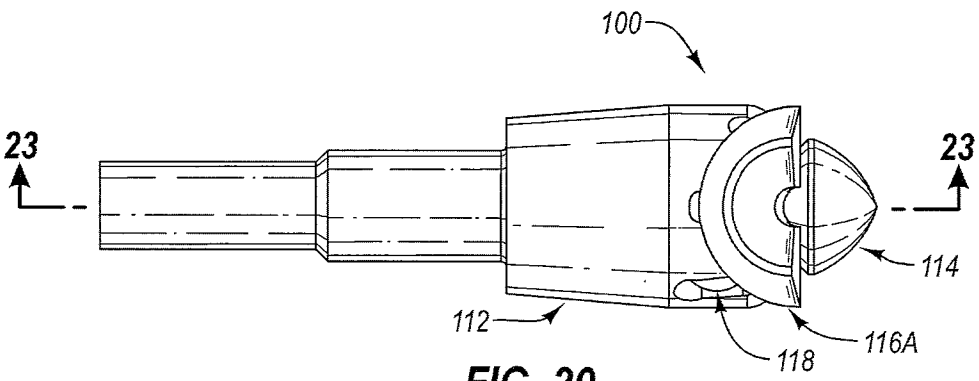
FIG. 20 is a first side view of the arrow point shown in FIG. 19.
Figure 22:
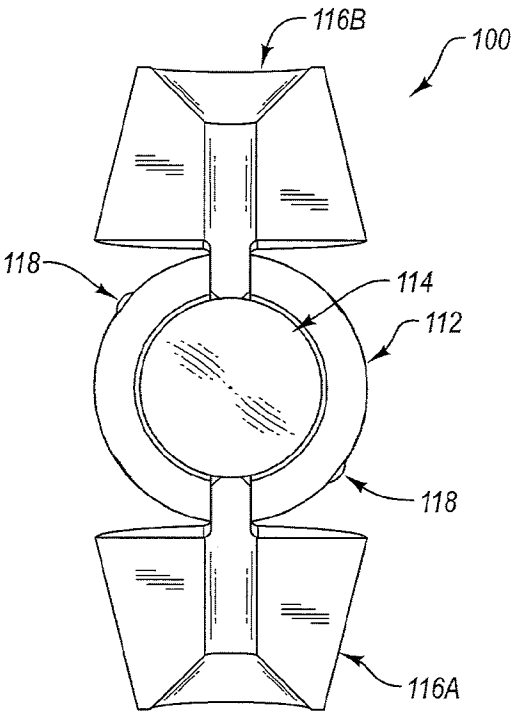
FIG. 22 is an end view of the arrow point shown in FIG. 19.
Figure 21:
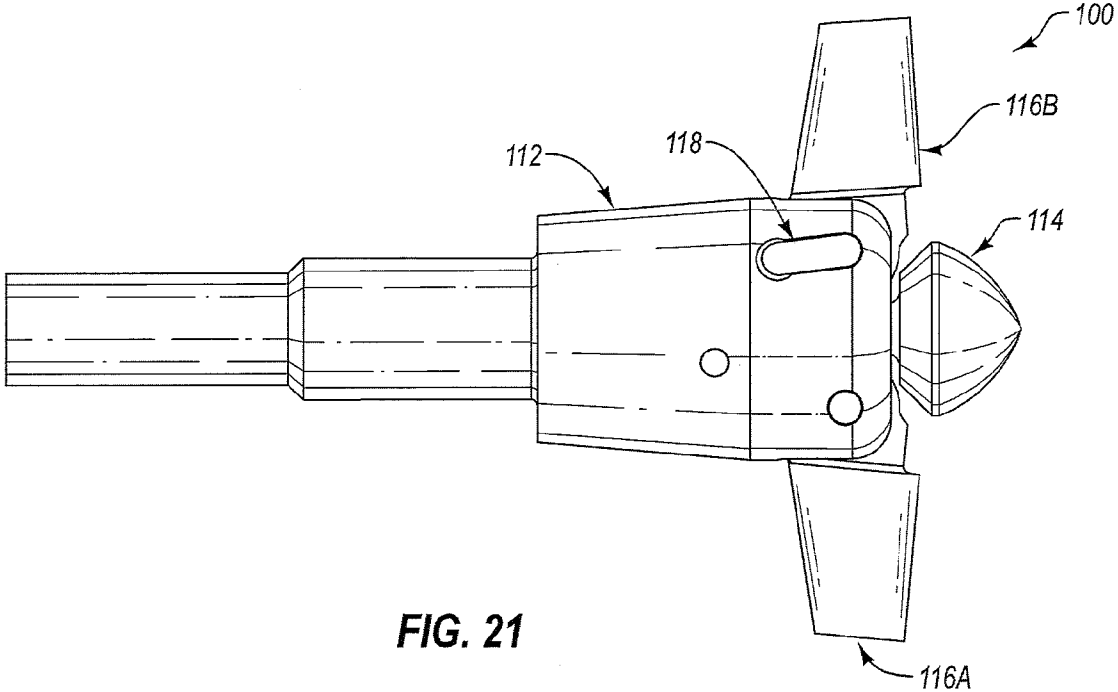
FIG. 21 is a second side view of the arrow point shown in FIG. 19.

FIG. 14A illustrates the first portion 51A of extension members 116A-B in contact with the biasing leg 72, and the biasing leg 72 in a first position within the biasing member opening 28 at a distance $F_1$ from leg 70 (see FIG. 14B), wherein the extension members 116A-B are in the unexpanded position. FIGS. 17A-B illustrate the second portion 51B of extension members 116A-B in contact the biasing leg 72, and the biasing leg 72 in a second position within the biasing member opening 28 at a greater distance $F_1$ from leg 70, wherein a biasing force is applied to the extension members 116A-B when in the partially expanded position. FIG. 22 illustrates the third portion 51C of extension members 116A-B in contact the biasing leg 72, and the biasing leg 72 moved to a third position within the biasing member opening 28 at a distance $F_1$ from leg 70 that is less than the distance $F_1$ shown in FIGS. 17A-B, wherein the extension members 116A-B are in the fully expanded position. The first and third positions may be substantially the same. Further details concerning operation of attachment pins 18 are provided in U.S. Pat. No. 6,793,596, which is incorporated herein in its entirety by this reference.

The use of both a pivot leg 70 and a biasing leg 72 for the attachment pins 18 may provide both a pivot point for the extension members 16A-C and apply a biasing force against the extension members 16A-C to help maintain the extension members 16A-C in a given rotated position using a single piece device. The biasing leg 72, alone or in combination with the pivot leg 70 and attachment pin 18 generally, may be referred to as a spring lock or a biasing lock.

Other arrangements for the attachment pins include, for example, separate pins, wherein one pin provides a pivotal connection of the extension members 16A-C to the base portion 12, and a separate pin applies a biasing force to the extension members 16A-C. Many other devices having various constructions may be used to help retain the extension members 16A-C mounted to the base portion 12, provide a pivotal connection of the extension members 16A-C to the base portion 12, and provide a biasing force to the extension members 16A-C to help retain the extension members 16A-C in certain rotated positions. In some arrangements, multiple devices may be used to provide these and other functions related to the extension members 16A-C.

Figure 13:
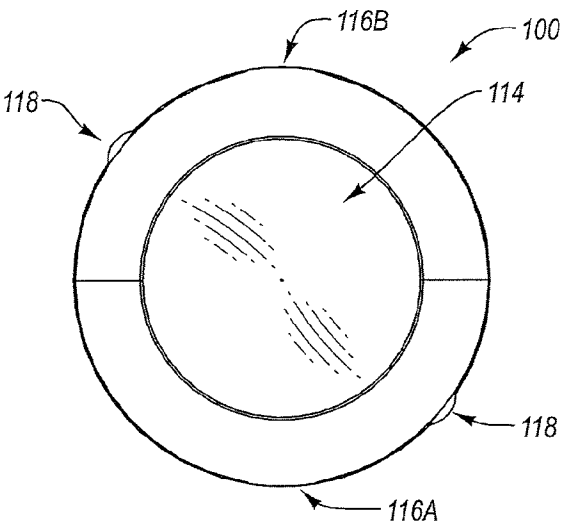
FIG. 13 is an end view of the arrow point shown in FIG. 10.
Figure 18:
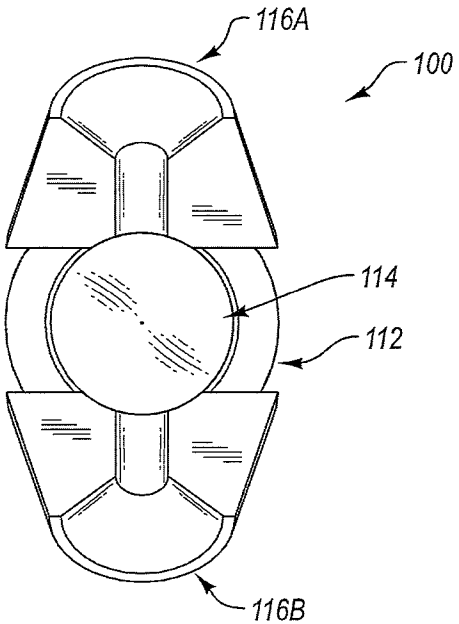
FIG. 18 is an end view of the arrow point shown in FIG. 15.

Referring now to FIGS. 10-23, another example expandable arrow point 100 is shown and described. The expandable arrow point 100 includes a base portion 112, a tip portion 114, a pair of extension members 116 A-B, and a plurality of attachment pins 118. The expandable arrow point 100 has a similar construction to the expandable arrow point 10 with exception of implementing two extension members instead of three extension members. FIGS. 14A-B, 17A-B, and 23 illustrate the extension members 116 A-B in cross-section in retracted, partially extended, and fully extended positions, respectively. A comparison of the retracted, partially extended, and fully extended versions of expandable arrow point 100 shown in FIGS. 13, 18 and 22 illustrates the increase of an exposed surface area of the expandable arrow point 100 as the extension members 116 A-B move towards the fully extended position.

In at least some arrangements, an expandable arrow point having three or more extension members has a greater exposed surface area facing in the distal direction as compared to an expandable arrow point having two or fewer extension members. As the number of extension members for an expandable arrow point increases, the surface area facing in the distal direction for a given extension member typically decreases.

The expandable arrow points disclosed herein may be maintained in the closed state or position during stowage and flight using an extension member retainer. The extension member retainer may be positioned on an exterior of the arrow point. The extension member retainer may be use in place of or in addition to other features (e.g., the biasing leg 72 and proximal cam surface 51 described above) that help retain the extension members in particular rotated positions.

Figure 34:
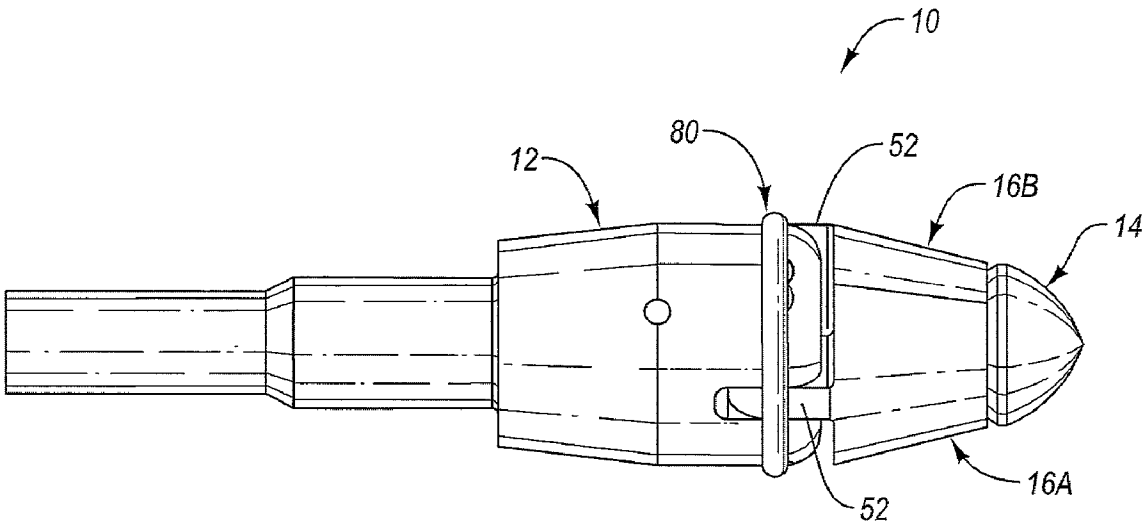
FIG. 34 is a side view of the arrow point shown in FIG. 33.
Figure 33:
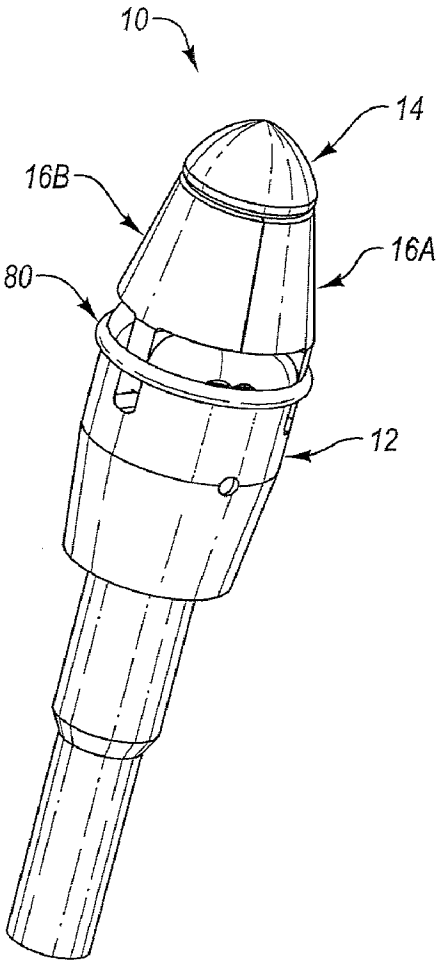
FIG. 33 is a perspective view of the arrow point shown in FIG. 1 with a retainer mounted thereto.

Referring now to FIGS. 33 and 34, an example extension member retainer 80 is shown positioned along an exterior of an expandable arrow point 10 at location radially adjacent to a portion of the extension members 16A-C. The extension member retainer 80 may be positioned at any location along a length of the extension members 16A-C. In at least one example, the extension member retainer 80 is positioned adjacent to a portion of the extension members 16A-C that is not tapered along the exterior surface. Positioning the extension member retainer 80 on an untapered portion of the extension members 16A-C may help maintain the extension member retainer 80 at a desired axial position during stowage and flight until the tip portion 14 contacts a target surface.

Figure 36:
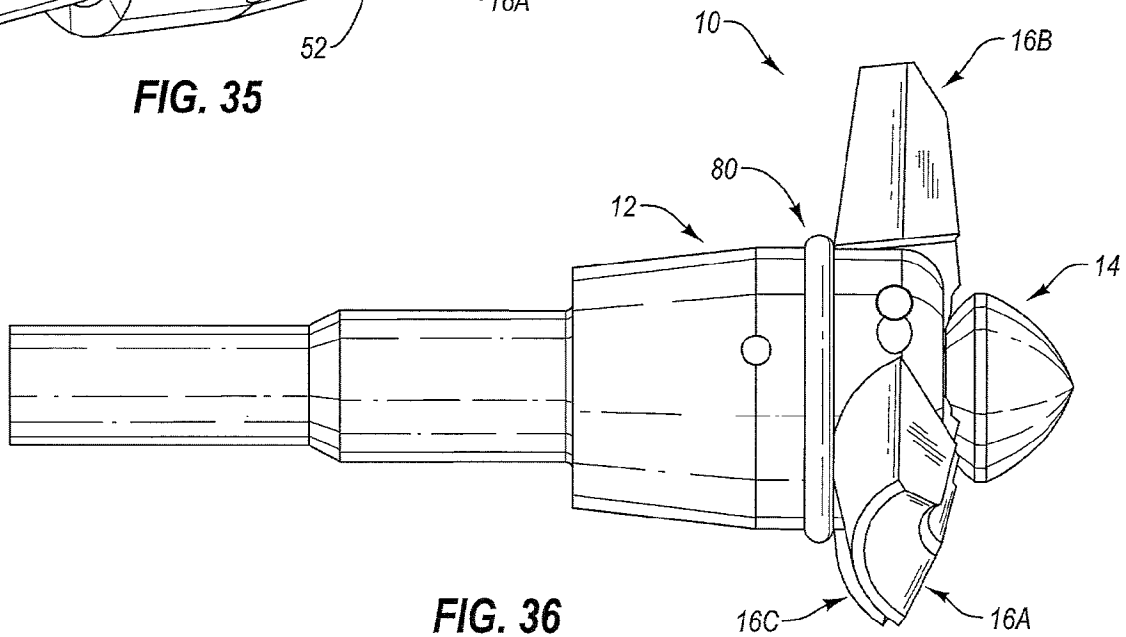
FIG. 36 is a side view of the arrow point shown in FIG. 33 with the extension members in a fully extended position.

In one example, the extension member retainer 80 is positioned radially adjacent to a portion of the base portion 12 as well as radially adjacent to a portion of the extension members 16A-C when the extension members 16A-C are in the retracted or unexpanded position (see FIGS. 33-34). The extension member retainer 80 may maintain constant contact with one or both of the base portion 12 and extension members 16A-C. The extension member retainer 80 may be movable in the proximal or rearward direction when the extension members move toward the fully extended position, as shown in FIG. 36. The extension member retainer 80 may be mounted to the base portion 12 and spaced proximal of the extension members 16A-C when the extension members 16A-C are rotated to the fully extended position (see FIG. 36). In some examples, the extension member retainer 80 is constructed to fail (i.e., break, tear, etc.) when the tip portion contacts the target and the extension members 16A-C rotate toward the fully extended position.

Figure 35:
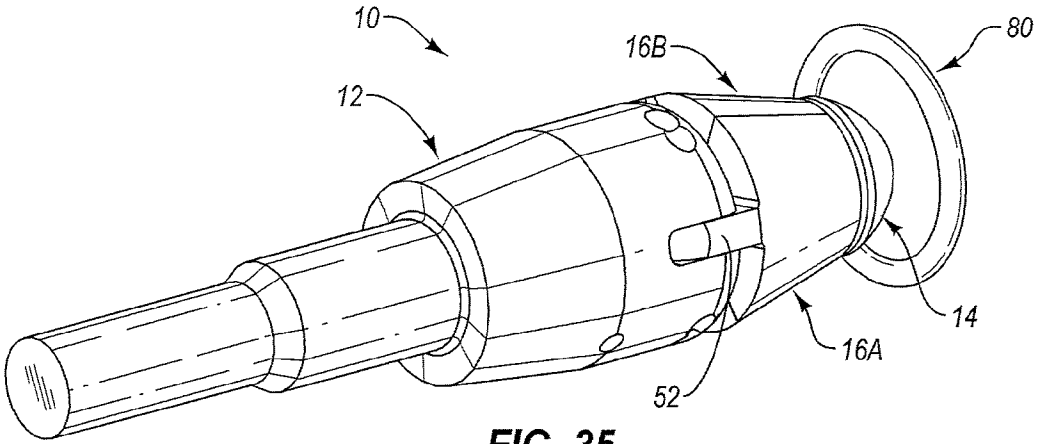
FIG. 35 is a partial exploded perspective view of the arrow point shown in FIG. 33.

The extension member retainer 80 may be mounted to the expandable arrow point 10 by inserting the tip portion 14 through an open interior of the extension member retainer 80 while the extension members 16A-C are in the retracted or unexpanded position. FIG. 35 illustrates the extension member retainer 80 positioned distal of the tip portion 14 and arranged for positioning along an exterior surface of the expandable arrow point 10. The extension member retainer 80 may comprise a resilient, elastic material. In some arrangements, the extension member retainer 80 defines an internal opening size that is smaller than an outer profile of the expandable arrow point 10 where the extension member retainer 80 is to be positioned (i.e., the position shown in FIGS. 33-34 radially adjacent to a proximal portion 52 of the extension members 16A-C).

The extension member retainer 80, when expanded outward to fit on an exterior surface of the expandable arrow point 10, may exert a radially inward directed force that may help retain the extension members 16A-C in the retracted, closed position shown in FIGS. 33-34. At least one of the material composition (i.e., elasticity of the material) or the construction of the extension member retainer 80 (i.e., maximum internal dimension) may permit removal of the extension member retainer 80 from the position radially adjacent to a portion of the extension members 16A-C so that the extension members 16A-C may rotate into the fully extended position shown in FIG. 36.

In one arrangement, the extension member retainer 80 is constructed as an O-ring. The O-ring construction may permit easier movement (e.g., rolling) of the extension member retainer 80 when being mounted to the exterior surface of the expandable arrow point 10 and when moving proximally as the extension members 16A-C begin rotating from the retracted position (see FIGS. 33-34) to the fully extended position (see FIG. 36). O-rings typically comprise an elastic material such as rubber that permits some expansion and stretching of the extension member retainer 80 for purposes of mounting the extension member retainer 80 to the expandable arrow point 10 and moving the extension member retainer 80 when the extension members 16A-C move toward the fully extended position. Other constructions and material compositions are possible for the extension member retainer 80, including construction and materials that are not elastic or deformable. At least some constructions and material compositions for the extension member retainer 80 may make it possible for the extension member retainer 80 to be reused and have an extended useful life beyond a single cycle of expanding the expandable arrow point 10.

In some examples, the expandable arrow point 10 may include a groove or recess (not shown) along a portion of an outer surface of the extension members 16A-C and/or the body portion 12. This groove or recess may help retain the extension member retainer 80 in a temporary axial position during stowage and flight of the expandable arrow point 10.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. An arrow point, comprising:

a base portion having a proximal end adapted for connection to an arrow shaft;

a tip portion mounted to the base portion and defining a distal surface of the arrow point;

a plurality of extension members each having a distal end, a proximal end, and a blunt surface, the proximal end of the extension members being pivotally mounted to the base portion, and the extension members being movable between a retracted position wherein the blunt surface is unexposed and an extended position wherein the blunt surface is exposed and facing in a generally distal direction.

2. The arrow point of claim 1, wherein the tip portion is axially movable relative to the base portion.

3. The arrow point of claim 2, wherein the tip portion contacts the extension members when in the retracted position, and axial movement of the tip portion in a proximal direction moves the extension members from the retracted position toward the extended position.

4. The arrow point of claim 1, wherein the tip portion includes a shaft that extends into the base portion, and a point positioned at a distal end of the shaft, the shaft having a smaller maximum outer dimension than a maximum outer dimension of the point.

5. The arrow point of claim 4, wherein the blunt surface faces the shaft in the retracted position, and faces perpendicular to the shaft in the extended position.

6. The arrow point of claim 1, wherein the extension members are oriented generally parallel with a length dimension of the arrow point in the retracted position, and generally perpendicular to the length dimension in the extended position.

7. The arrow point of claim 1, wherein the plurality of extension members includes two extension members, the extension members defining a continuous circumference of the arrow point when in the retracted position.

8. The arrow point of claim 1, wherein the plurality of extension members include three extension members, the extension members defining a continuous circumference of the arrow point when in the retracted position.

9. The arrow point of claim 1, wherein an outer surface of the extension members define a surface that tapers toward the tip portion when the extension members are in the retracted position.

10. The arrow point of claim 1, further comprising a plurality of attachment pins configured to releaseably connect the extension members to the base portion, the attachment pins including a biasing portion and a pivot portion, the biasing portion configured to apply a biasing force to the extension members to maintain the extension members in a retracted position.

11. The arrow point of claim 1, further comprising a retainer positioned radially adjacent to a portion of the plurality of extension members, the retainer being removable from the radially adjacent position when the extension members move from the retracted position to the extended position.

12. An arrow point adapted to be secured to an end of an arrow shaft, comprising a tip portion;

a plurality of blunt extension members, each blunt extension member including a distal end and a proximal end, the blunt extension members being pivotable about the proximal end to orient a blunt surface of the blunt extension member in a generally distal facing direction;

wherein the tip portion is movable in a proximal direction relative to the arrow shaft, and proximal movement of the tip portion pivots the blunt extension members.

13. An arrow point adapted to be secured to an end of an arrow shaft, comprising a tip portion;

a plurality of blunt extension members, each blunt extension member including a distal end and a proximal end, the blunt extension members being pivotable about the proximal end to orient a blunt surface of the blunt extension member in a generally distal facing direction;

wherein the blunt extension members are pivotable from a retracted position in which the blunt surface is oriented in a radially inward facing direction, and an extended position wherein the blunt surface is oriented in a generally distal facing direction.

14. The arrow point of claim 13, wherein each blunt extension member includes a plurality of blunt surfaces that face in the generally distal facing direction when in the extended position.

15. An arrow point adapted to be secured to an end of an arrow shaft, comprising a tip portion;

a plurality of blunt extension members, each blunt extension member including a distal end and a proximal end, the blunt extension members being pivotable about the proximal end to orient a blunt surface of the blunt extension member in a generally distal facing direction;

wherein the tip portion defines a first cam surface that faces a proximal direction, and the blunt extension members each define a second cam surface that faces a distal direction, and the tip portion is moveable in the proximal direction to contact the first and second cam surfaces thereby pivoting the blunt extension members.

16. An arrow assembly, comprising:

an arrow shaft;

an arrow point mounted to the arrow shaft, the arrow point including a plurality of blunt extension members, the blunt extension members having proximal and distal ends and being pivotally mounted to the arrow point at the proximal end, the distal end being movable between a retracted position wherein the blunt extension members define a tapered outer surface of the arrow point, and an extended position wherein the distal ends are positioned radially outward and a blunt surface of the blunt extension members is exposed.

17. The arrow assembly of claim 16, wherein the arrow point further comprises a base portion to which the blunt extension members are pivotally mounted, and a slidable tip portion that moves the blunt extension members from the retracted position to the extended position.

18. The arrow assembly of claim 16, wherein the blunt extension members extend perpendicular to a longitudinal dimension of the arrow point when in the extended position.

19. A method of operating an expandable arrow point, comprising:

providing an arrow point having a base portion, a plurality of extension members, and a tip portion, the extension members being pivotally mounted to the base portion at a proximal end of the extension members, the extension members defining a blunt surface;

arranging the extension members in a retracted position with a distal end of the extension members positioned adjacent to the tip portion and the blunt surface facing radially inward;

moving the tip portion proximally, wherein proximal movement of the tip portion pivots the extension members toward an extended position to expose the blunt surface.

20. The method of claim 19, wherein the extended position orients the blunt surface facing in a generally distal direction.

* * * * *